US011661721B2

(12) United States Patent
Hussain et al.

(10) Patent No.: US 11,661,721 B2
(45) Date of Patent: May 30, 2023

(54) APPARATUS AND METHOD FOR SEABED RESOURCES COLLECTION

(71) Applicant: OCEAN MINERAL SINGAPORE HOLDING PTE. LTD., Singapore (SG)

(72) Inventors: Anis Hussain, Singapore (SG); Aziz Merchant, Singapore (SG)

(73) Assignee: OCEAN MINERAL SINGAPORE HOLDING PTE. LTD., Singapore (SG)

( * ) Notice: Subject to any disclaimer, the term of this patent is extended or adjusted under 35 U.S.C. 154(b) by 454 days.

(21) Appl. No.: 16/828,329

(22) Filed: Mar. 24, 2020

(65) Prior Publication Data

US 2020/0308805 A1 Oct. 1, 2020

(30) Foreign Application Priority Data

Apr. 1, 2019 (SG) ..... 10201902911Y

(51) Int. Cl.
*E21C 50/00* (2006.01)
*E02F 5/00* (2006.01)
(Continued)

(52) U.S. Cl.
CPC ..... *E02F 5/006* (2013.01); *E02F 3/885* (2013.01); *E02F 3/8866* (2013.01); *E02F 7/005* (2013.01); *E02F 7/10* (2013.01)

(58) Field of Classification Search
CPC ..... E02F 5/006; E02F 3/885; E02F 3/8866; E02F 7/005; E02F 7/10; E02F 7/06;
(Continued)

(56) References Cited

U.S. PATENT DOCUMENTS 3,943,644 A * 3/1976 Walz ..... E02F 3/081 198/710
6,223,675 B1 * 5/2001 Watt ..... E21B 41/04 405/190

(Continued)

FOREIGN PATENT DOCUMENTS

CN 106761761 A 5/2017
FR 2089926 A5 1/1972

(Continued)

OTHER PUBLICATIONS

Chung, et al., "Smart Seafloor Mining Vehicle: Simulation with Successive Learning Track-Keeping Control," International Society of Offshore and Polar Engineers, vol. 10, Issue 3, 2000.

(Continued)

*Primary Examiner* — Edwin J Toledo-Duran
(74) *Attorney, Agent, or Firm* — M&B IP Analysts, LLC

(57) ABSTRACT

Embodiments of the invention provide apparatus and method for seabed resources collection. The apparatus comprises a main module and a plurality of seabed resources collecting devices releasably attached to the main module, wherein the main module and the plurality of collecting devices are configured to be launched from a surface vessel towards a seabed; the main module includes a control module which is configured to determine a mining path for each of the collecting devices based on characteristics of the seabed, control each of the collecting devices to collect seabed resources along the determined mining path and control transfer of the seabed resources collected by the collecting devices, wherein each collecting device is configured to be released from the main module after the apparatus is launched, and to collect seabed resources along the mining path determined by the main module after being released.

34 Claims, 19 Drawing Sheets

(51) Int. Cl.
*E02F 3/88* (2006.01)
*E02F 7/00* (2006.01)
*E02F 7/10* (2006.01)

(58) Field of Classification Search
CPC ..... E02F 9/2054; E02F 3/90; E02F 3/8833; E02F 3/8858; E21B 41/04; E21B 43/017; E21B 17/015; E21C 50/00; E21C 50/02
See application file for complete search history.

(56) References Cited

U.S. PATENT DOCUMENTS 9,080,425 B2 * 7/2015 Zediker ..... B63G 8/001
10,458,235 B2 * 10/2019 Halkyard ..... E02F 7/023
2013/0139415 A1 * 6/2013 Halkyard ..... E02F 3/8875 37/307
2013/0241263 A1 * 9/2013 Jones ..... E02F 5/006 299/9
2013/0298430 A1 * 11/2013 Jones ..... E02F 3/8866 37/313
2013/0312296 A1 * 11/2013 Jones ..... E02F 7/06 37/317
2014/0137442 A1 * 5/2014 Jones ..... E02F 7/10 37/307
2016/0032704 A1 * 2/2016 Liu ..... E21B 44/00 73/865.6
2018/0266074 A1 * 9/2018 Halkyard ..... E02F 7/005
2019/0345688 A1 * 11/2019 Crowther ..... E02F 3/8875

FOREIGN PATENT DOCUMENTS

KR 101369830 B1 * 2/2014 ..... E02F 3/8833
KR 101580974 B1 12/2015
WO 2009136064 A1 11/2009
WO WO-2009136064 A1 * 11/2009 ..... E02F 3/8833

OTHER PUBLICATIONS

The European Search Report for European Application No. 20163234.6 dated Jul. 1, 2020, EPO, Munich, Germany.

* cited by examiner

APPARATUS AND METHOD FOR SEABED RESOURCES COLLECTION

CROSS-REFERENCE TO RELATED APPLICATIONS

This application claims priority to the Singapore Application No. 10201902911Y, filed Apr. 1, 2019, now pending, the contents of which are hereby incorporated by reference.

FIELD OF INVENTION

The invention generally relates to an apparatus for collecting seabed resources wherein the apparatus includes a plurality of collecting devices configured to collect seabed resources along a predetermined mining path, and a method thereof.

BACKGROUND

It is known that exploration and exploitation of seabed resources, e.g. seabed nodules or ores, are essential to obtaining mineral resources to satisfy the gradually increasing demand for mineral resources. Despite the variety of apparatuses proposed for the seabed resources collection, the process of collecting seabed resources in deep oceans and transferring the collected resources from the seabed to a surface ship in an efficient manner remains difficult.

U.S. Pat. No. 4,685,742 A discloses an apparatus for extracting ores from the seabed. This apparatus includes a plurality of collecting devices for collecting seabed ores, and a relay unit configured to raise the collected seabed resources to a surface vessel through a raising conduit. However, with this apparatus, the efficiency of collecting seabed resources may be very low due to overlapping of working areas of different collecting devices and undesired obstacles on the relevant seabed.

Another apparatus for collecting seabed resources proposed in KR 1369830 B1 includes a plurality of collecting robots/devices for collecting seabed resources, and an area dividing device configured to generate signals to divide the relevant seabed, i.e. the seabed on which the apparatus is to collect seabed resources, into different working areas for different collecting robots/devices. In this solution, although different collecting robots/devices are assigned respective working areas, the efficiency of collecting seabed resources is still very low.

Other different system/apparatus for seabed resources collection are also described in patent publications, e.g. a system for recovering a deposit from the seabed disclosed in US20140230287A1 and a deep sea mining system disclosed in CN2016158747U.

It is therefore desirable to provide a solution for collecting seabed resources in a more efficient manner.

SUMMARY OF INVENTION

In order to provide a more efficient solution for seabed resources collection, embodiments of the invention discloses various systems and methods for collection and transfer of seabed resources.

According to one aspect of the invention, an apparatus for collecting seabed resources is provided. The apparatus comprises:

a main module and a plurality of seabed resources collecting devices releasably attached to the main module, wherein the main module and the plurality of collecting devices are configured to be launched from a surface vessel towards a seabed;

wherein the main module includes a control module which is configured to determine a mining path for each of the collecting devices based on characteristics of the seabed, control each of the collecting devices to collect seabed resources along the determined mining path and control transfer of seabed resources collected by the collecting devices, wherein each collecting device is configured to be released from the main module after the apparatus is launched, and to collect seabed resources along the mining path determined by the main module after being released.

In some embodiments of the invention, the apparatus including the main module together with the collecting devices is launched from the surface vessel and is positioned at a predetermined height above the seabed.

In some embodiments of the invention, the apparatus including the main module together with the collecting devices is launched from the surface vessel and landed on the seabed.

In some embodiments of the invention, the collecting devices are movably and communicably connected to the main module for power transfer from the main module to the collecting devices, resources transfer from the collecting devices to the main module and communication therebetween.

In some embodiments of the invention, after the collecting devices are released from the main module, the collecting devices are communicated with the main module in a wireless manner as there are no physical connections between the collecting devices and the main module.

According to another aspect of the invention, a method for collecting seabed resources is provided. The method comprises:

launching an apparatus for collecting seabed resources from a surface vessel towards a seabed, wherein the apparatus includes a main module and a plurality of collecting devices releasably attached to the main module;

determining, by the main module, a mining path for each of the plurality of collecting devices based on characteristics of the seabed;

releasing the plurality of collecting devices from the main module;

controlling, by the main module, each of the collecting devices to collect seabed resources along the mining path determined by the main module; and controlling, by the main module, transfer of the seabed resources collected by the collecting devices.

With the apparatus and method provided in embodiments of the invention, the mining path of each of the plurality of collecting devices can be controlled by the main module of the apparatus according to the information relating to the characteristics of the relevant seabed. Further, the transfer of the seabed resources from the collecting devices to the main module and/or from the main module to the surface vessel is also controlled by the main module. Thus, the efficiency of the seabed resources collection can be significantly improved.

BRIEF DESCRIPTION OF THE DRAWINGS

The invention will be described in detail with reference to the accompanying drawings, in which.

DETAILED DESCRIPTION OF EMBODIMENTS OF THE INVENTION

Figure 1A:
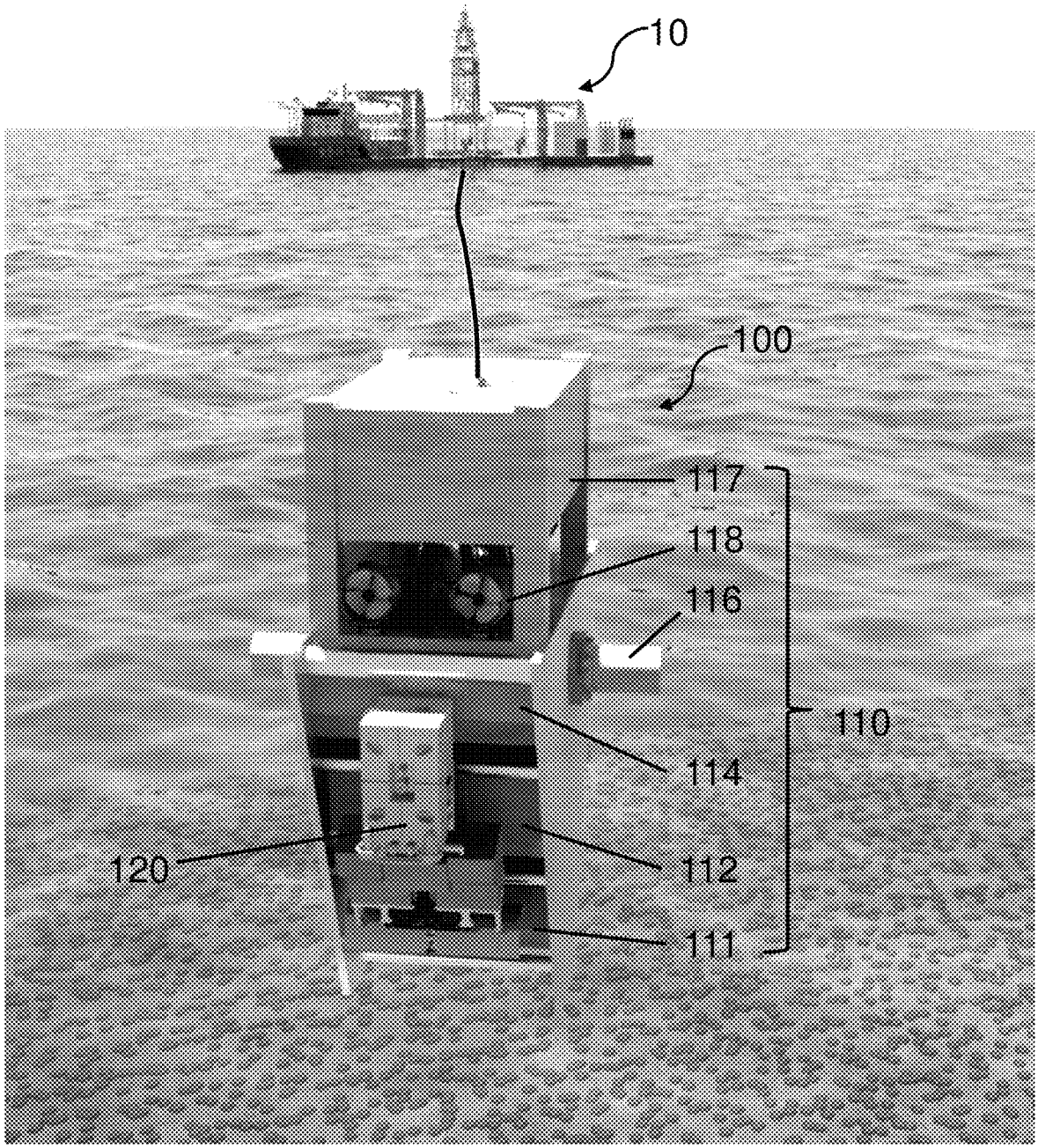
FIG. 1A shows a perspective view of an apparatus for collecting seabed resources when the apparatus is being lowered from a surface vessel according to a first embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. It is understood that the terminology used herein is for the purpose of describing particular embodiments only, and is not intended to limit the scope of the invention. In the drawings, like reference numerals refer to same or similar functionalities or features throughout the several views.

Embodiments described in the context of one of the methods or apparatuses are analogously valid for the other methods or apparatuses. Similarly, embodiments described in the context of a method are analogously valid for an apparatus, and vice versa.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

As used herein, the articles "a", "an" and "the" as used with regard to a feature or element include a reference to one or more of the features or elements.

As used herein, the term "and/or" includes any and all combinations of one or more of the associated listed items.

As used herein, the terms "first," "second," and "third," etc. are used merely as labels, and are not intended to impose numerical requirements on their objects.

As used herein, the term "each other" denotes a reciprocal relation between two or more objects, depending on the number of objects involved.

As used herein, the terms "pipe" and "hose" are mutually interchangeable and refer to a hollow body or conduit or passage for conveying substances including solid and/or fluid substances. These terms are not intended to impose rigidity or flexibility properties.

As used herein, the terms "fluidly connected to" refers to "be in fluid communication with". For example, if a first module is fluidly connected to a second module, a mixture of liquid and/or solid seabed resources may be transferred from the first module to the second module, and/or vice versa.

Embodiments of the invention provide an apparatus for collecting seabed resources wherein the apparatus includes a main module and a plurality of seabed resources collecting devices. The collecting devices are releasably and attached/locked/latched to the main module. The main module, together with the attached collecting devices, is configured to be launched from a surface vessel towards a seabed to start seabed resources collection. After launch, the main module is connected to the surface vessel and remotely controlled by the surface vessel. The main module includes a control module which is configured to determine an exploitation/mining path for each of the collecting devices based on characteristics of the relevant seabed, e.g. bathymetry, geographical features of the relevant seabed (e.g. undulation on the seabed), intensity distribution and volume of the seabed resources on the relevant seabed (e.g. nodule abundance), and soil strength of the relevant seabed, etc. Here, the relevant seabed refers to the seabed or an area thereof on which the apparatus is to collect seabed resources.

Further, the main module is also configured to control each of the collecting devices to collect seabed resources along the determined mining path and control transfer of the collected seabed resources, e.g. the transfer of the collected seabed resources from the collecting devices to the main module and/or the transfer of the seabed resources away from the main module to a surface vessel.

Each of the collecting devices is configured to be released/unlatched from the main module, and collect seabed resources along the mining path determined by the main module after being released.

In some embodiments of the invention, each of the collecting devices is provided with at least one scanning means, e.g. sensor, to scan the seabed to collect information relating to the characteristics of the seabed and send the collected information to the main module. Accordingly, the main module is configured to determine the mining path for each of the collecting device based on the received information.

Some examples are provided below to further explain how the main module determines the mining path for each of the collecting devices and how the main module controls each of the collecting devices to collect seabed resources along the determined mining path.

The main module may be further configured to determine whether there is overlap between the mining paths of the collecting devices based on the received information, and adjust the mining path for at least one of the collecting devices if there is overlap.

In some examples, each of the collecting devices may be configured to scan the seabed to check the soil strength thereof and sends the information relating to the soil strength to the main module. Accordingly, the main module may be configured to analyse the received information to determine tractive force required for the collecting device and control the collecting device to adjust the tractive force.

In some examples, each of the collecting devices may be configured to scan the seabed to check nodule abundance thereof and send the information/data relating to the nodule abundance to the main module. Accordingly, the main module may be configured to send an instruction to the collecting device to prepare for collection if the nodule abundance satisfies a predetermined requirement.

In some examples, the main module may be configured to determine a collection rate for each of the collecting devices. The collection rate may be determined based on the information/data in relation to the characteristics of the seabed and a predetermined annual collection rate.

In some examples, the main module may be configured to update the mining path for each of the collecting devices based on real time information which relate to the characteristics of the seabed and is received from the collecting device. Thus, the mining path of each collecting device can be adjusted timely based on the information relating to the characteristics of the seabed to further improve the efficiency of seabed resources collection.

In some examples, each of the collecting devices may be configured to scan the seabed to check its undulation and send the information relating to the undulation to the main module. Accordingly, the main module may be configured to control the collecting device to stop or start seabed resources collection based on the information relating to the undulation, e.g. the slope or degree of the undulation. For example, if the slope of the undulation is greater than a predetermined degree, e.g. 10 degrees, the main module is configured to send an instruction to the collecting device to stop seabed resources collection. Further, the main module may be configured to determine the tractive force required for the collecting device based on the slope degree of the undulation and adjust the tractive force required for the collecting device accordingly.

In some examples, the main module may be configured to determine if a turning mechanism is required to be activated based on the real time information relating to characteristics of the seabed and received from the collecting devices, and control the collecting device to stop collection and activate the turning mechanism if necessary.

It should be noted that the examples mentioned above are for illustrative purpose only, not for limiting the scope of the invention. In other examples, the main module may determine the mining path for each of the collecting devices based on the characteristics of the seabed and control the collecting devices to collect seabed resources in other ways.

In some embodiments of the invention, the whole apparatus including the main module and the collecting devices may be landed on the seabed, while in other embodiments, at least part of the apparatus or even the whole apparatus may be positioned at a predetermined height above the seabed to minimise environment disturbances to the seabed caused by the process of seabed resources collection.

Figure 1B:
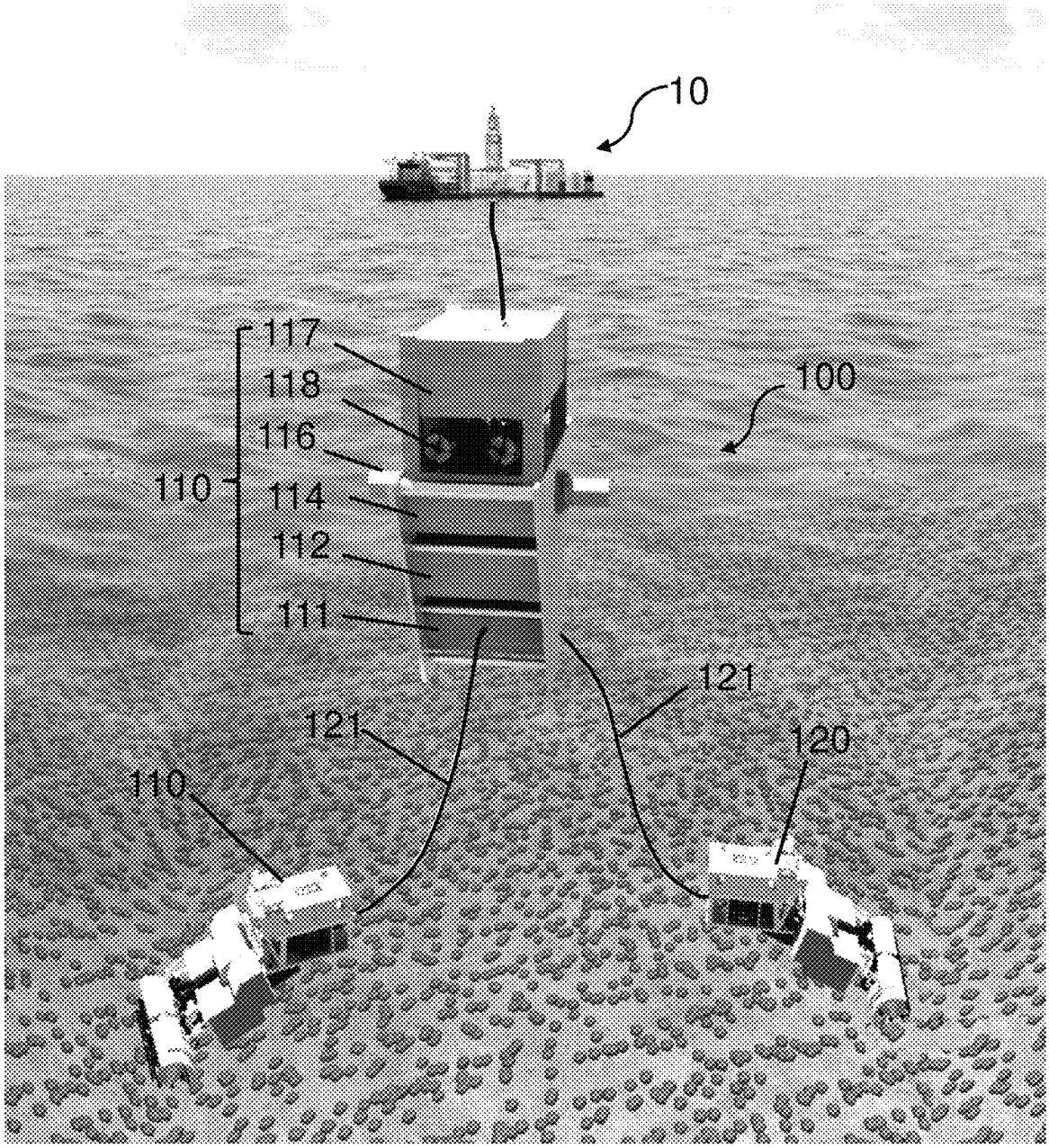
FIG. 1B shows a perspective view of the apparatus of FIG. 1A when it is in use or operational state according to the first embodiment of the invention.

FIG. 1A shows a perspective view of an apparatus 100 for collecting seabed resources when the apparatus 100 is being lowered from a surface vessel 10 according to a first embodiment of the invention. FIG. 1B shows a perspective view of the apparatus 100 when it is in use according to the first embodiment of the invention.

Referring to FIGS. 1A to 1B, in this embodiment, the apparatus 100 includes a main module 110 and two collecting devices 120. The main module 110 is connected to the surface vessel 10 and remotely controlled by means of power and communication cables from the surface vessel 10. The two collecting devices 120 are releasably attached to the main module 110.

As shown in FIG. 1A, the main module 110, together with the collecting devices 120, is lowered/launched from the surface vessel 10 towards the seabed till the whole apparatus 100 hovers at a predetermined height above the seabed.

As shown in FIG. 1B, after the apparatus 100 is launched and subsequently hovers at the predetermined height above the seabed, the collecting devices 120 are released from the main module 110 and subsequently hover at a predetermined height above the seabed to collect seabed resources. After release from the main module 110, each of the collecting devices 120 is movably and communicably connected to the main module 110 by a connecting cord 121. In one example, the connecting cord 121 may be a hybrid flow hose for communication between the main module 110 and the collecting device 120, power transfer from the main module 110 to the collecting device 120 and resource transfer from the collecting device 120 to the main module 110.

As shown in FIGS. 1A and 1B, the main module 110 includes a control module 111, a filtering module 112, a storage module 114, a seabed resource offloading mechanism 116, a buoyancy module and frame 117 and vectored thrusters 118.

In the main module 110, the control module 111 is communicably connected to the surface vessel 10 and each of the collecting devices 120. The control module 111 is configured to determine a mining path for each of the collecting devices 120 based on the information relating to characteristics of the seabed and control each of the collecting devices 120 to collect seabed resources along the determined mining path. In this embodiment, the information relating to characteristics of the seabed may be collected by the collecting devices 120 using at least one sensor provided thereon. To further improve the efficiency of the seabed resource collection, the control module 111 may be further configured to determine non-overlapping mining paths for the collecting devices based on the received information.

The control module 111 may be fluidly connected to each of the collecting devices 120 and configured to control transfer of the collected seabed resources from the collecting devices 120 to the surface vessel 10.

The filtering module 112 is configured to at least partially remove the sediments, e.g. sand particles and/or slurry, from the collected seabed resources. Different types of filtering module 112 may be interchangeably used in the apparatus 100. Three different types of filtering modules, e.g. a filtering module including a centrifuge system or a water sprinkler system, will be further explained in detail later in this description. The apparatus 100 may include any one of the three different filtering modules which works alone or any combination of the different filtering modules, e.g. the apparatus 100 may include all of the three filtering modules which work together in series, i.e. one after another.

In some embodiments, the collected seabed resources may be first transferred to the control module 111 by a pump assembly provided in the main module 110 and then transferred to the filtering module 112 through an interface between the control module 111 and the filtering module 112.

The storage module 114 is configured to temporarily store the filtered seabed resources before the seabed resources are transferred away from the main module 110. The filtered seabed resources may be transferred to the storage module 114 through an interface between the filtering module 112 and the storage module 114.

The interface between the control module 111 and the filtering module 112 or the interface between the filtering module 112 and the storage module 114 may include at least one hose and a pump assembly. The hose may include a valve which only allows one-way flow transfer of the seabed resources.

It should be noted that in some other embodiments, the seabed resources may be transferred directly from the collecting devices 120 to the filtering module 112 for filtration. That is to say, in some embodiments, the apparatus may not include an interface between the control module 111 and the filtering module 112 for transferring seabed resources and the control module 111 is only used to control transfer of the seabed resources from the collecting devices 120 to the filtering module 112, e.g. by means of a valve arranged between a collecting device 120 and the filtering module 112.

As shown in FIG. 1A and FIG. 1B, the apparatus 100 may further include a buoyancy module and frame 117 and vectored thrusters 118 which are configured to counteract drag forces from the seabed current such that the apparatus 100 can move along a substantially vertical path and not sway in horizontal direction. It is to be appreciated that the number of the vectored thrusters used in the apparatus 100 may vary depending on, e.g. the number of the collecting devices 120 included in the apparatus 100.

Figure 1C:
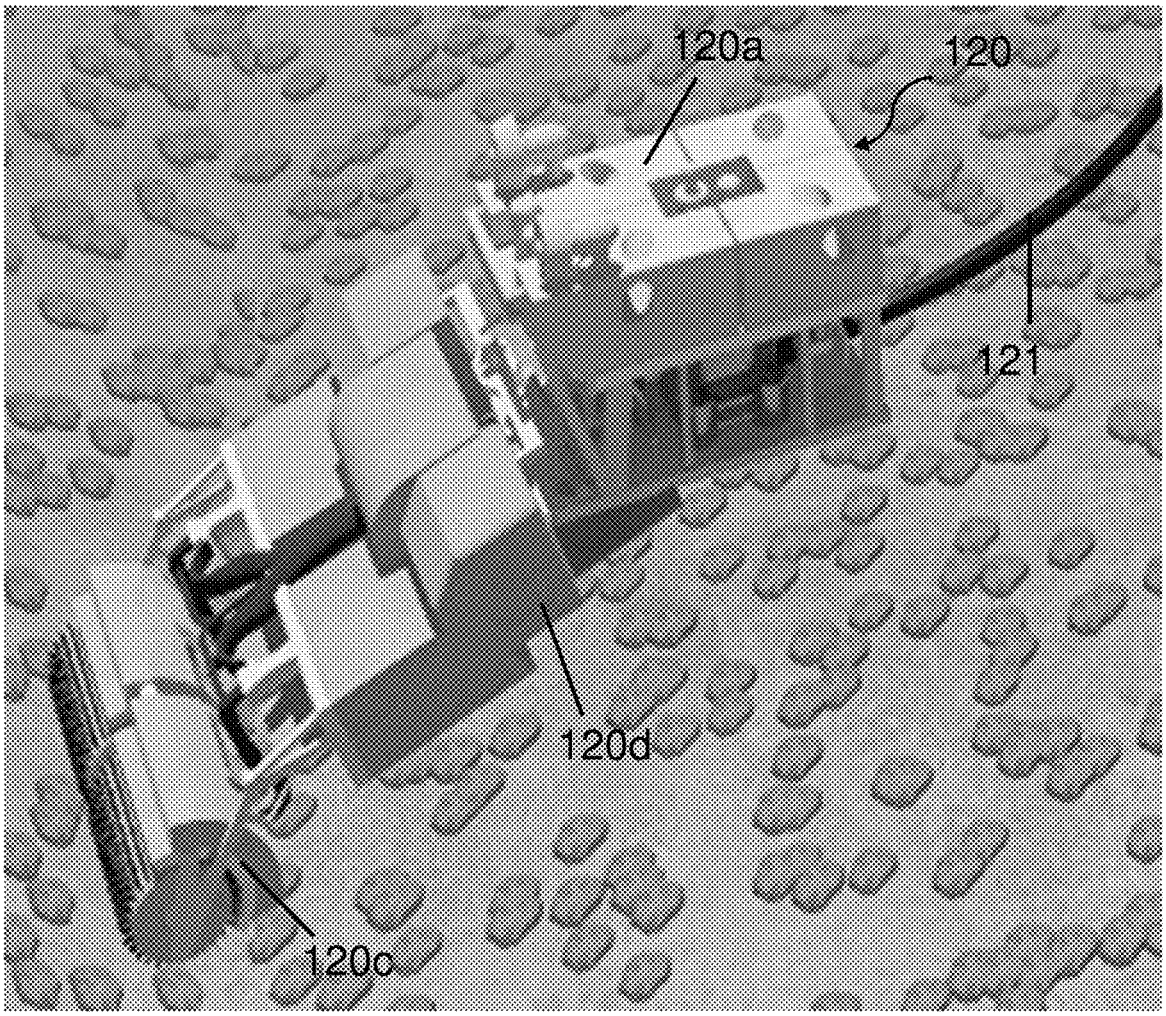
FIG. 1C shows a perspective view of a collecting device according to the first embodiment of the invention.

FIG. 1C shows a perspective view of a collecting device 120 according to the first embodiment of the invention. In this embodiment, each collecting device 120 includes a propulsion means 120*a*, at least one scanning means 120*b* (not shown in FIG. 1C), a resource collecting means 120*c* and a resource storage module 120*d*.

The propulsion means 120*a* is configured to enable the collecting device 120 to hover above the seabed or prevent the collecting device 120 from landing or sinking to the seabed. The at least one scanning means 120*b* may be at least one sensor or other scanning device which is configured to obtain information relating to characteristics of the seabed. The resource collecting means 120*c* is configured to collect seabed resources at least along the mining path determined by the main module 110.

The resource storage module 120*d* is configured to temporarily store the seabed resources collected by the resource collecting means 120*c* before the collected seabed resources are transferred away from the collecting device 120.

It is to be appreciated that the resource storage module 120*d* is an optional component, and in some embodiments of the invention, the collecting device may not include the resource storage module.

Figure 1D:
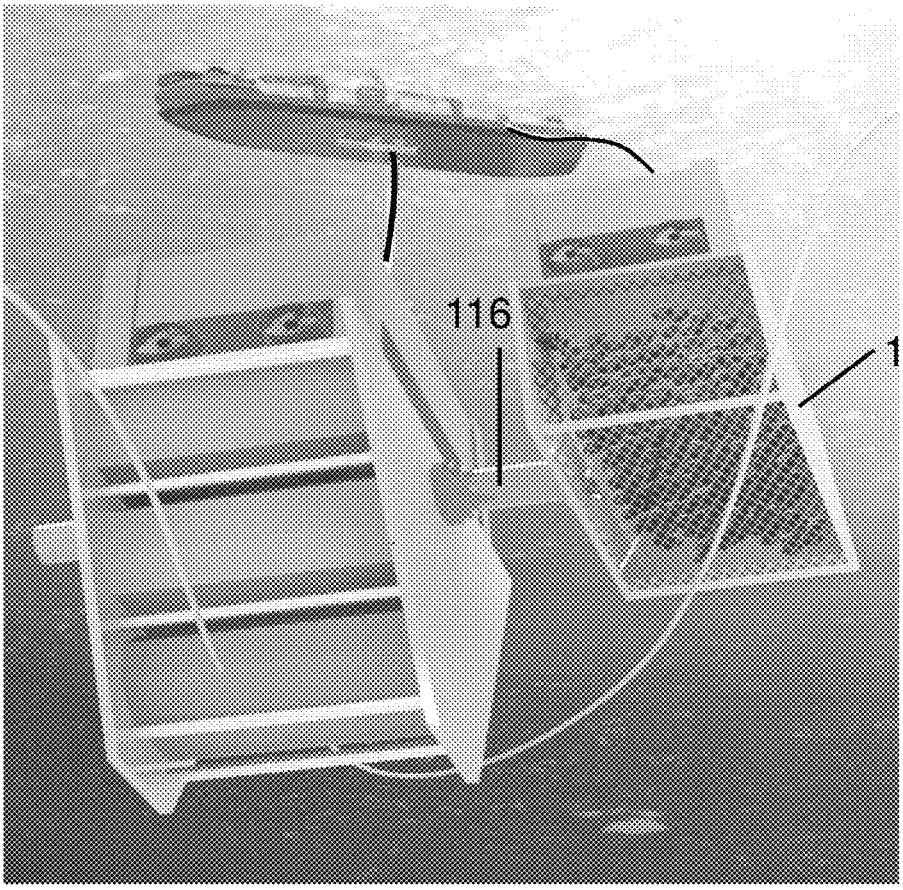
FIG. 1D shows a thruster assisted Vertical Transport System (VTS) provided to assist in transfer of seabed resources to the surface vessel according to the first embodiment of the invention.

To more efficiently transfer the seabed resources from the main module 110 to the surface vessel 10, referring to FIG. 1D, the apparatus 100 may be further provided with a conveying system. The conveying system includes a thruster assisted Vertical Transport System (VTS) 140. The VTS 140 may be connected to the surface vessel 10 by an umbilical for power transfer and communication therebetween and configured to assist in transferring seabed resources stored in the main module 110 to the surface vessel 10.

Specifically, the VTS 140 is configured to be launched/lowered from the surface vessel 10 to a position near the main module 110 by side launching using launching rope(s) and a deck crane or winch. After launch, the VTS 140 is configured to be engaged with/fluidly connected to the main module 110 to receive seabed resources from the main module 110. After at least partially filled with seabed resources, the VTS 140 is configured to be lifted up to the surface vessel 10, e.g. by a winch or deck crane on the surface vessel 10. Thus, the seabed resources stored in the main module 110 is transferred to the surface vessel 10 with assistance of the VTS 140.

Figure 1E:
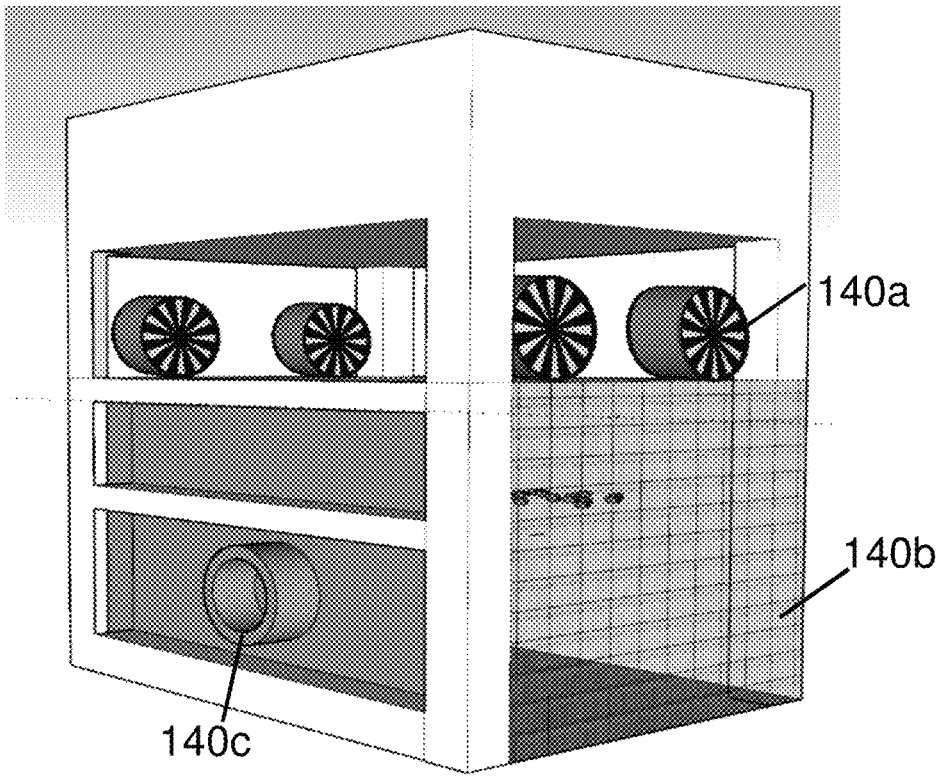
FIG. 1E shows a side perspective view of the thruster assisted Vertical Transport System (VTS) of FIG. 1D according to the first embodiment of the invention.

In some embodiments, the VTS 140 may include a vectored thruster 140*a*, a storage container 140*b* and a connecting means 140*c* as shown in FIG. 1E. The vector thruster 140*a* is configured to counteract drag forces due to seabed current such that the VTS 140 can move along a substantially vertical path between the seabed and the surface vessel 10 or seawater surface. Besides that, the vector thruster 140*a* is also used to assist in station keeping and dynamic positioning of the VTS 140, e.g. maintain the VTS 140 at a desired location relative to the surface vessel 10 and ensure the VTS 140 can move along the desired path and heading. The container 140*b* is configured to store the seabed resources transferred from the main module 110. The connecting means 140*c*, e.g. a receptacle, tube, is configured to engage with the main module 110 to enable transfer of seabed resources from the main module 110 to the VTS 140. For example, the connecting means 140*c* is engaged or fitted with the seabed resource offloading mechanism 116 to provide a passage for resource transfer from the main module 110 to the VST 140. The pump assembly in the main module 110 may be used to facilitate transfer of the seabed resources from the main module 110 to the VST 140.

Figure 1F:
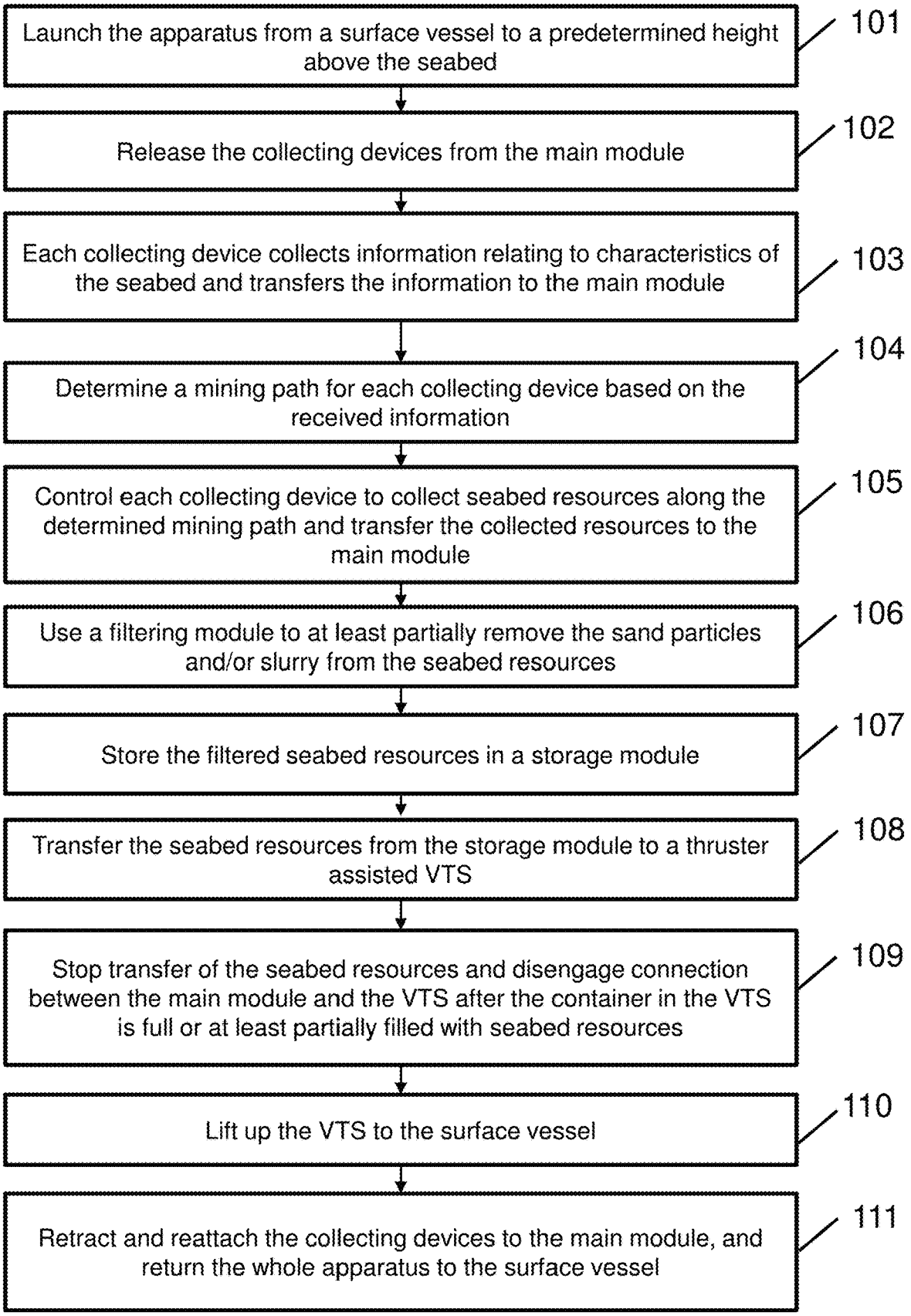
FIG. 1F is a flow chart illustrating a method for collecting seabed resources using the apparatus according to the first embodiment of the invention.

FIG. 1F is a flowchart illustrating a method of collecting seabed resources using the apparatus 100 according to the first embodiment of the invention.

In block 101, the apparatus 100 is launched, e.g. lowered, from the surface vessel 10 to a predetermined height above the seabed, i.e. an intermediate position between the seabed and the surface vessel or seawater surface, e.g. 100 meters above the seabed.

The height of the apparatus 100 may be determined by an altimeter provided on the apparatus 100.

In block 102, the plurality of collecting devices 120 are released from the main module 110, and each collecting device 120 hovers at a predetermined location above the seabed. At this time, apparatus 100 is in an extended position wherein at least some of the collecting devices 120 are unlatched from the main module 100 and spread out.

In this embodiment of the invention, the whole apparatus 100 is positioned at a predetermined height above the seabed to minimize environment disturbances to the seabed caused by the process of collecting seabed resources.

In block 103, each collecting device 120 collects, by the at least one scanning device, information relating to characteristics of the seabed and transfers the information to the main module 110.

In this embodiment, the characteristics of the relevant seabed may be selected from the group consisting of bathymetry, geographical features of the relevant seabed, intensity distribution and volume of seabed resources on the relevant seabed, and soil strength of the relevant seabed.

In block 104, the main module 110, particularly the control module 111, determines a mining path for each of the collecting devices 120 based on the received information relating to the characteristics of the seabed.

To further improve the efficiency of the resources collection, the control module 111 may further determine whether there is overlap between the mining paths for the collecting devices 120 based on the received information relating to the characteristics of the seabed, and adjusts the mining path for at least one collecting device 120 to avoid overlap of mining paths.

In block 105, the main module 110 controls each collecting device 120 to collect seabed resources along the mining path determined by the main module 110 and transfer the collected seabed resources to the main module 110.

The transfer of the seabed resources from the collecting devices 120 to the main module 110 is conducted by using a pump assembly provided at the main module 110 through the connection cord 121 between the collecting devices 120 and the main module 110.

In block 106, sediments, e.g. sand particles and/or slurry, are at least partially removed from the seabed resources by using the filtering module 112 provided at the main module 110.

In block 107, the filtered seabed resources are transferred to the storage module 114 in the main module 110 through an interface between the filtering module 112 and the storage module 114.

In block 108, seabed resources stored in the storage module 114 is transferred to a thruster assisted Vertical Transport System (VTS) 140.

The VTS 140 is launched from the surface vessel 10 and hovers a predetermined location near the main module 110. The VTS 140 is engaged with the main module 110 such that the seabed resources can be transferred from the main module 110 to the VTS 140.

In one embodiment, the VTS 140 is launched from a side of the surface vessel 10 using an A-shaped frame by a launching rope. When the VTS 140 reaches vicinity of the main module 110, the VTS 140 communicates with the main module 110 by means of transponders and sensors to initiate transfer of seabed resource from the main module 110 to the VTS 140.

In block 109, after the container 140*b* is full or at least partially filled with seabed resources, the transfer of seabed resources is stopped and the connection between the VTS 140 and the main module 110 is disengaged or released.

In block 110, the VTS 140 is lifted up to the surface vessel 10, e.g. by a winch, such that the seabed resources can be transferred to the surface vessel 10.

In block 111, the collecting devices 120 are withdrawn/retracted to the main module 110, and reattached to the main module 110. At this time, apparatus 100 is in a retracted position wherein the whole apparatus 100 is arranged in an unused or non-operational state and returned to the surface vessel 10.

Figure 2A:
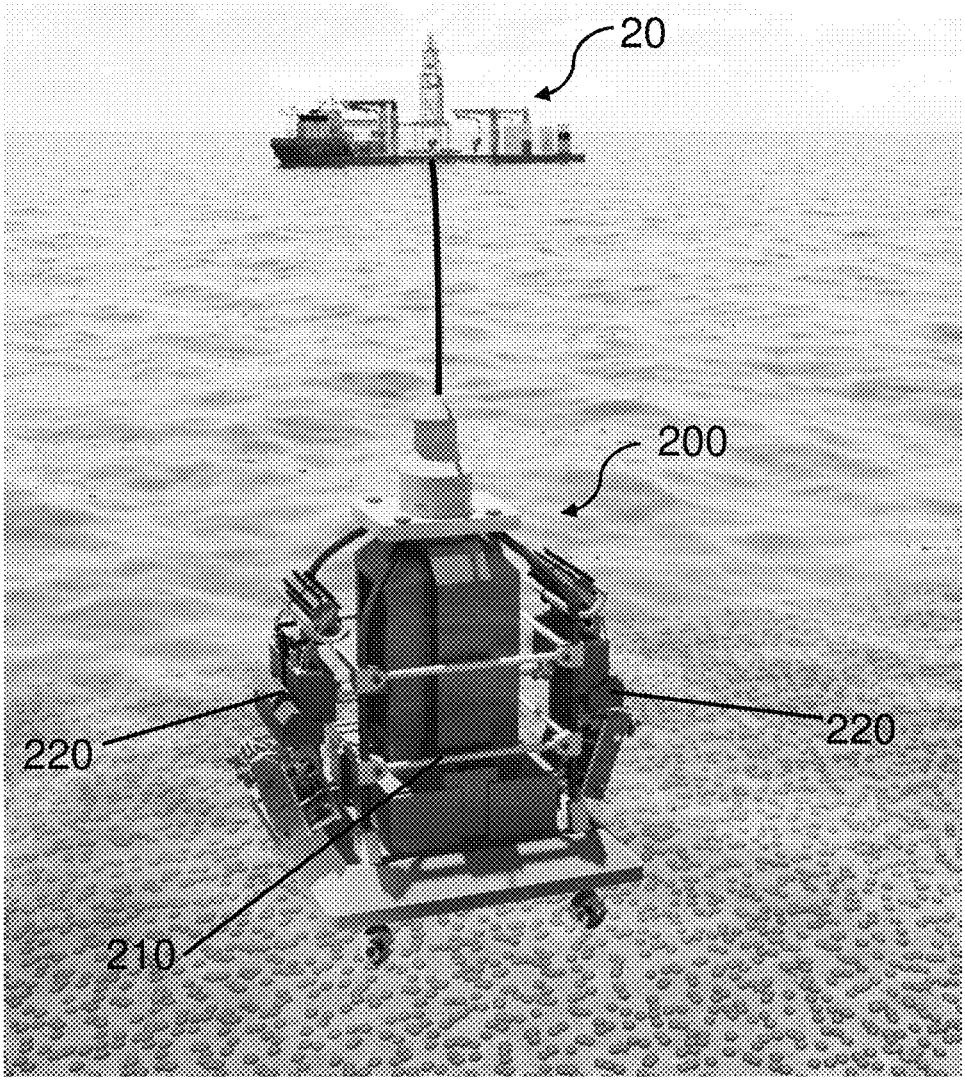
FIG. 2A is a perspective view of an apparatus for collecting seabed resources when the apparatus is being lowered from a surface vessel according to a second embodiment of the invention.
Figure 2B:
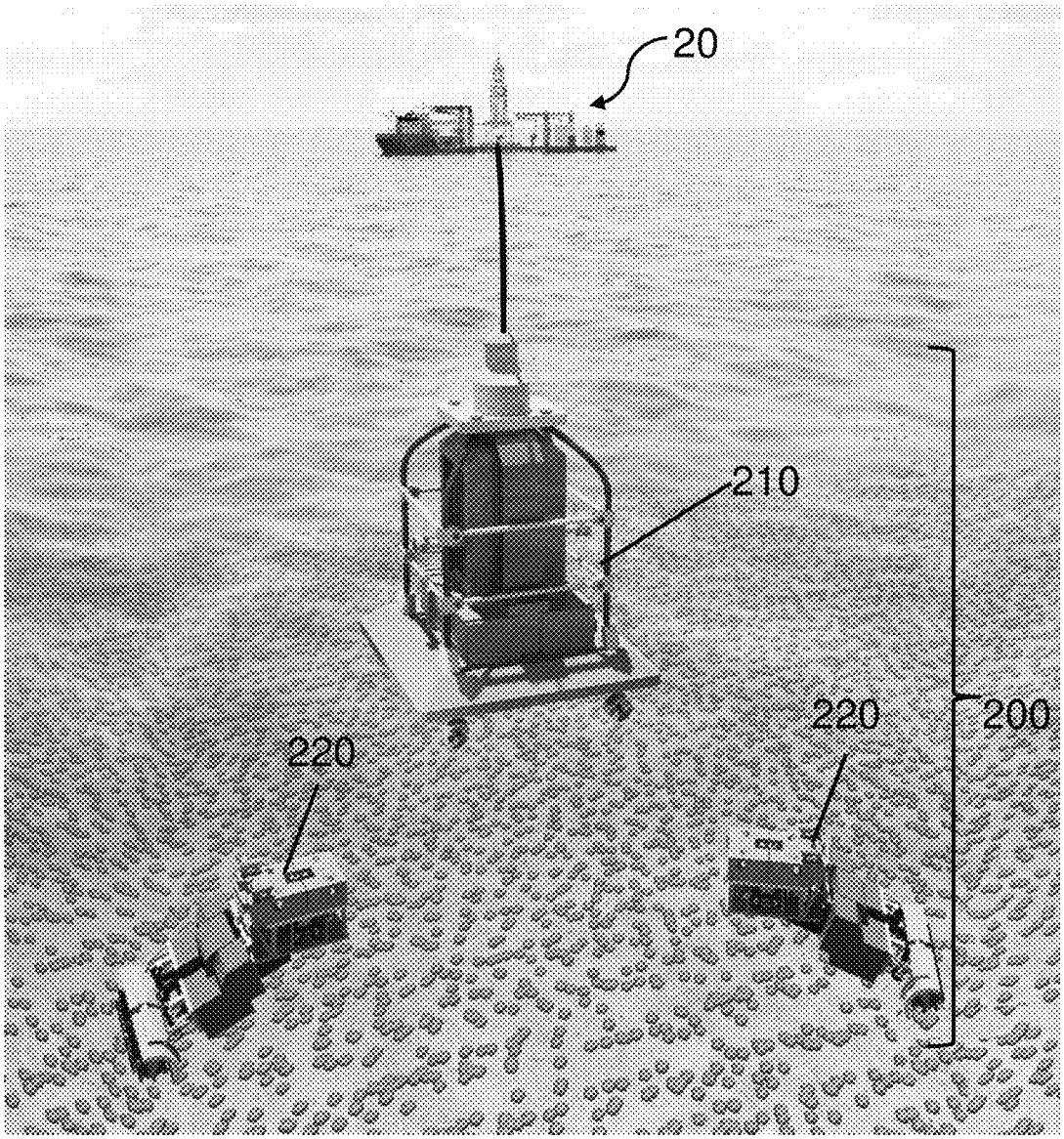
FIG. 2B is a perspective view of the apparatus in FIG. 2A when it is in use.
Figure 2C:
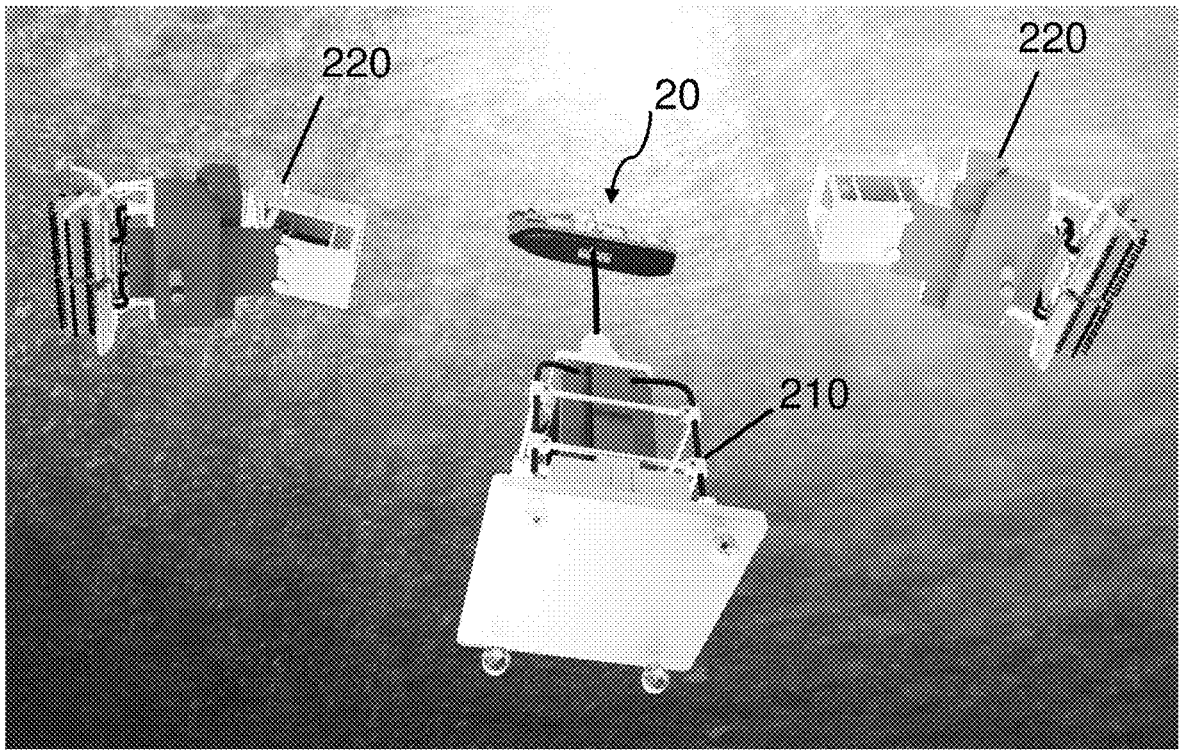
FIG. 2C is a bottom perspective view of the apparatus in FIG. 2A when it is in use.

As described above, in the first embodiment, each collecting device 120 is communicably connected to the main module 110 by the a hybrid flow hose 121, while, in some other embodiments, each of the collecting device may be remotely controlled by the main module in a wireless manner as shown in FIGS. 2A to 2C.

FIG. 2A is a perspective view of an apparatus 200 for collecting seabed resources when the apparatus 200 is being lowered from a surface vessel 20 according to a second embodiment of the invention. FIG. 2B is a perspective view of the apparatus 200 when it is in use. FIG. 2C is a bottom perspective view of the apparatus 200 when it is in use. As shown in FIG. 2C, similar to the first embodiment, in this second embodiment, both the main module 210 and the collecting devices 220 attached thereto are positioned at a predetermined height above the seabed when the collecting devices 220 are used for seabed resources collection.

In the second embodiment as shown in FIG. 2B, unlike the first embodiment, when the collecting devices 220 are released from the main module 210, there is no physical connection between the collecting devices 220 and the main module 210. Thus, the power and resource transfer between the collecting devices 220 and the main module 210 cannot be realized once the collecting devices are released from the main module 210.

However, the information/data communication between the main module 210 and the collecting devices 220 can still be performed in a wireless manner (sonar based communication), e.g. by a sensor suit provided on each collecting device 220. That is to say, after being released from the main module 110, each of the collecting devices 220 is configured to collect information relating to the characteristics of the seabed and transmit the collected information to the main module 210 in a wireless manner. Accordingly, the main module 210 is configured to determine the mining path for each of the collecting devices 220 based on the received information, control each of the collecting devices 220 to collect seabed resources along the determined mining path.

As there is no physical connection between the collecting devices 220 and the main module 210, each collecting device 220 is configured to store the collected seabed resources in a storage module 220*d* therein and return to the main module 220 once the storage module 220*d* is at least partially filled with seabed resources. Accordingly, the main module 210 is further configured to control the transfer of the seabed resources stored in the collecting device 220 from the collecting device 220 to the main module 210 after the collecting device 220 is reattached to the main module 210.

In a third embodiment of the invention, unlike the first and the second embodiments, the apparatus for collecting seabed resources is launched from a surface vessel and landed on the seabed.

Figure 3A:
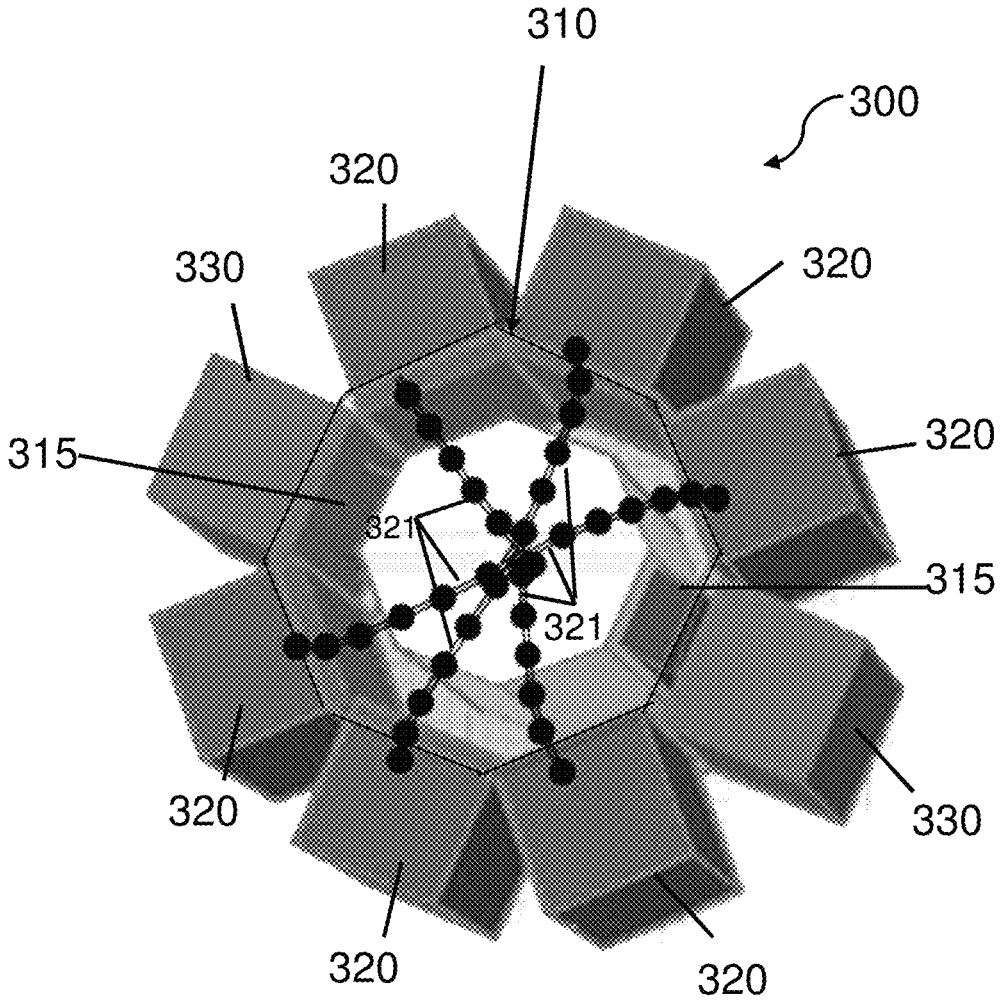
FIG. 3A is a top perspective view of an apparatus for collecting seabed resources according to a third embodiment of the invention.
Figure 3B:
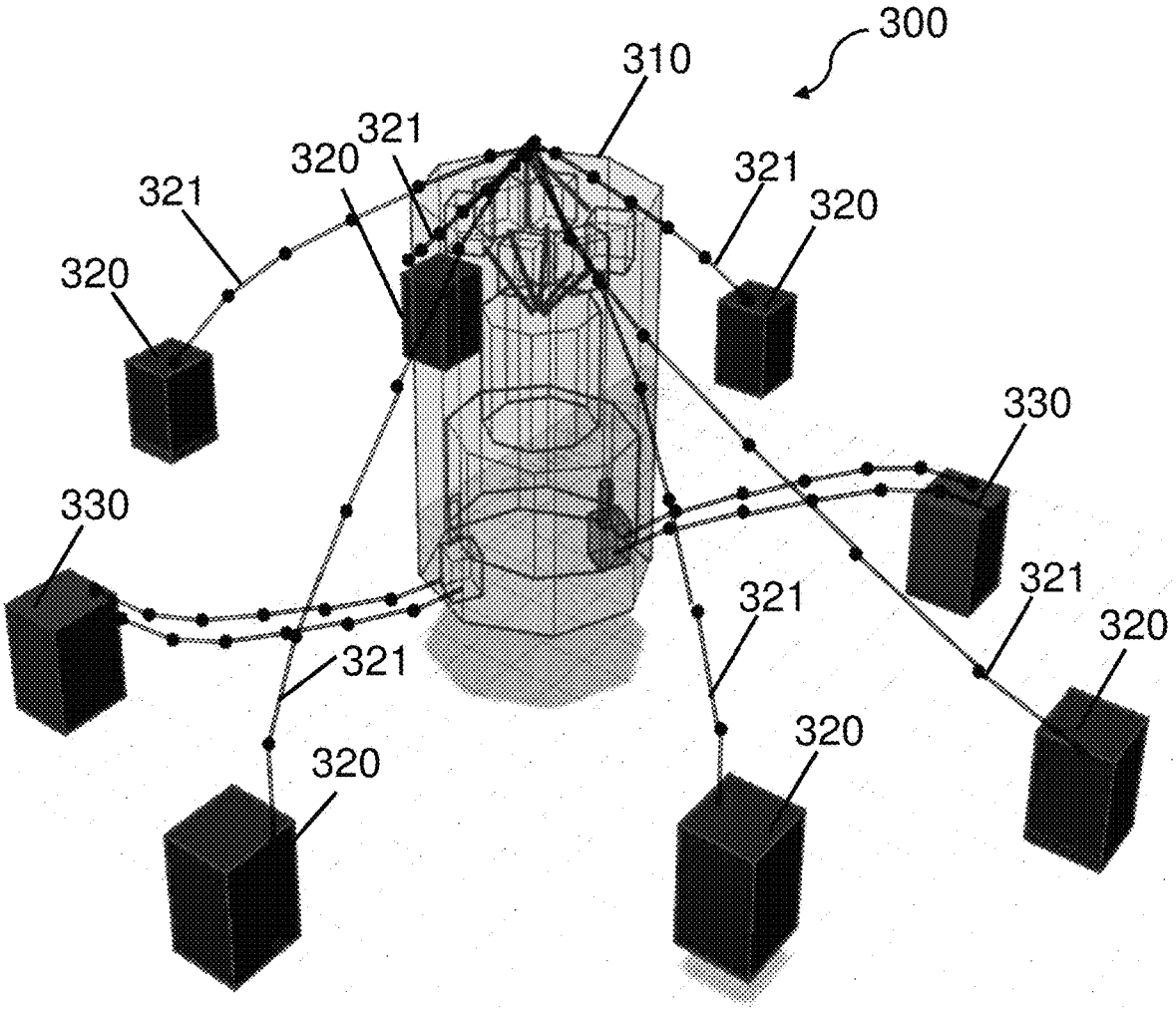
FIG. 3B shows a side perspective view of the apparatus in FIG. 2A when the apparatus is in use.

FIG. 3A shows a top view of an apparatus 300 for collecting seabed resources when the apparatus 300 is in an un-used state according to the third embodiment of the invention. Referring to FIG. 3B, the apparatus 300 includes a main module 310 and six seabed resources collecting devices 320. FIG. 3B shows a perspective view of the apparatus 300 when it is in use according to the third embodiment.

As shown in FIG. 3A, each of the collecting devices 320 is releasably attached to the main module 310 when the collecting devices 320 are not in use, while when the collecting devices 320 are released from the main module 310, each of the collecting devices 320 is movably and communicably connected to the main module 310 by a connecting cord 321, which is a hybrid flow hose for power transfer, data communication and resource transfer between the collecting device 320 and the main module 310.

As shown in FIG. 3B, the hybrid flow hoses 321 connect the individual collecting devices 320 to a pump assembly 315 which is configured to provide suction force for collecting seabed resources from the seabed to the collecting devices 320 and to provide force for transferring collected seabed resources from the collecting devices 320 to the main module 310. In this embodiment, the pump assembly 315 includes six pumps which are respectively connected to the six collecting devices 320 by the hybrid flow hoses 321. The hybrid flow hoses 321 respectively connect the six collecting devices 320 to the main module 310 to facilitate information/data and resource transfer between the main module 110 and each of the collecting devices 120 connected thereto.

The main module 310 may be connected to the surface vessel 30 and configured to be remotely controlled by a surface vessel 30. The main module 310 includes a control module (not shown in the Figures) which is configured to determine a mining path for each of the collecting devices 320 based on characteristics of the seabed, and to control the collecting devices 320 to collect seabed resources along the determined mining path and control transfer of the seabed resources from the collecting devices 320 to the surface vessel 30. Each of the collecting devices 320 is configured to be released from the main module 310 after the apparatus 300 is launched and landed on the seabed, and to collect seabed resources along the mining path determined by the main module 310 after being released from the main module 310.

In embodiments of the invention, characteristics of the relevant seabed may include bathymetry, geographical features of the relevant seabed, intensity distribution and volume of seabed resources on the relevant seabed, and soil strength of the relevant seabed, etc.

To more effectively and accurately determine the mining path for each of the collection devices 320, in some embodiments of the invention, each of the collecting devices 320 is provided with at least one sensor or other scanning device for collecting/gathering information relating to characteristics of the relevant seabed and the main module 310 is further configured to receive the information collected by each collecting device 320 and determine the mining path for each collecting device 320 based on the received information.

Figure 3C:
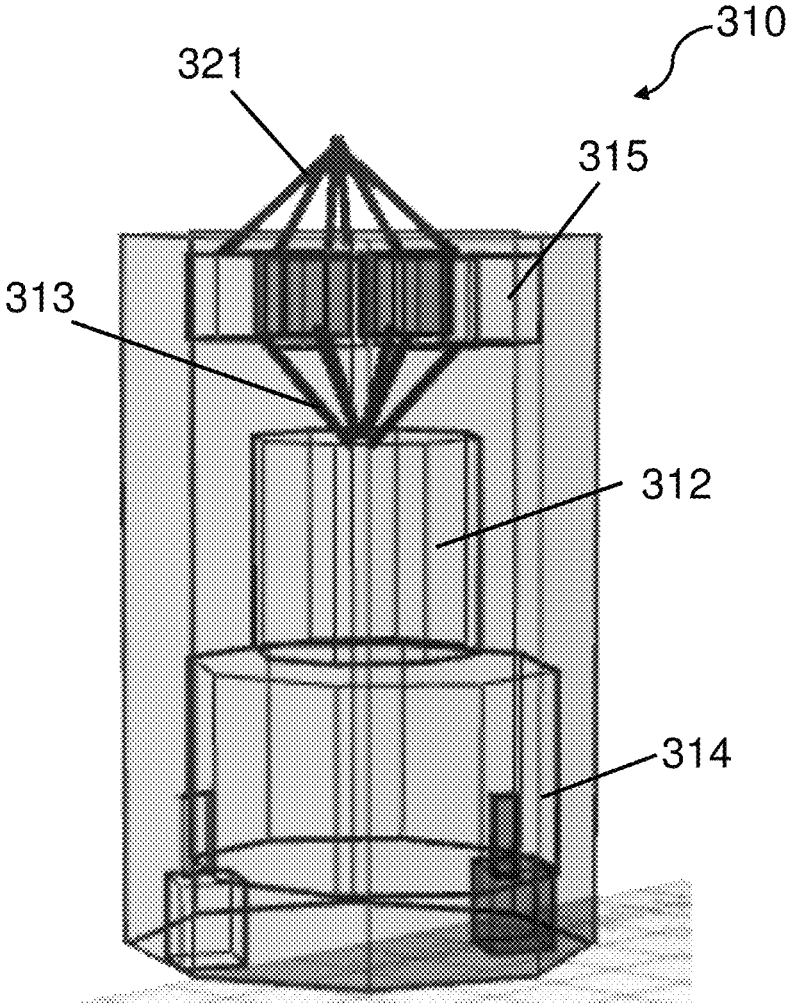
FIG. 3C shows a side perspective view of the main module in the apparatus shown in FIG. 3A.

FIG. 3C shows a side perspective view of the apparatus 300 for collecting seabed resources. As shown in FIG. 3C, to at least partially remove sand particles and/or slurry from the collected seabed resources, in some embodiments of the invention, the main module 310 may further include a filtering module 312. The filtering module 312 receives the resource along with the sand and slurry from the collecting devices 320 through the pump assembly 315 and the hoses 313.

Referring to FIGS. 3B and 3C, to temporarily store filtered seabed resources produced by the filtering module 312, in some embodiments of the invention, the main module 310 may further include a storage module 314. The storage module 314 is connected to the pump assembly 315 by a connecting hose. The pump assembly 315 is arranged to transfer the temporarily stored seabed resources away from the storage module 314, e.g. to a container located outside the main module 310.

Different types of filtering modules 312 may be interchangeably used in the apparatus 300. In some embodiments of the invention, the filtering module 312 may include at least one input/feed channel arranged to allow the collected seabed resources enter the filtering module 312; a filter arranged to at least partially remove the sand particles and/or slurry from the collected seabed resources; at least one output/filtrate channel arranged to allow the filtered seabed resources to be transported out of the filtering module 312, e.g. to the storage module 314; and at least one waste discharge channel arranged to discharge the sand particles and/or slurry from the main module 310.

Figure 4A:
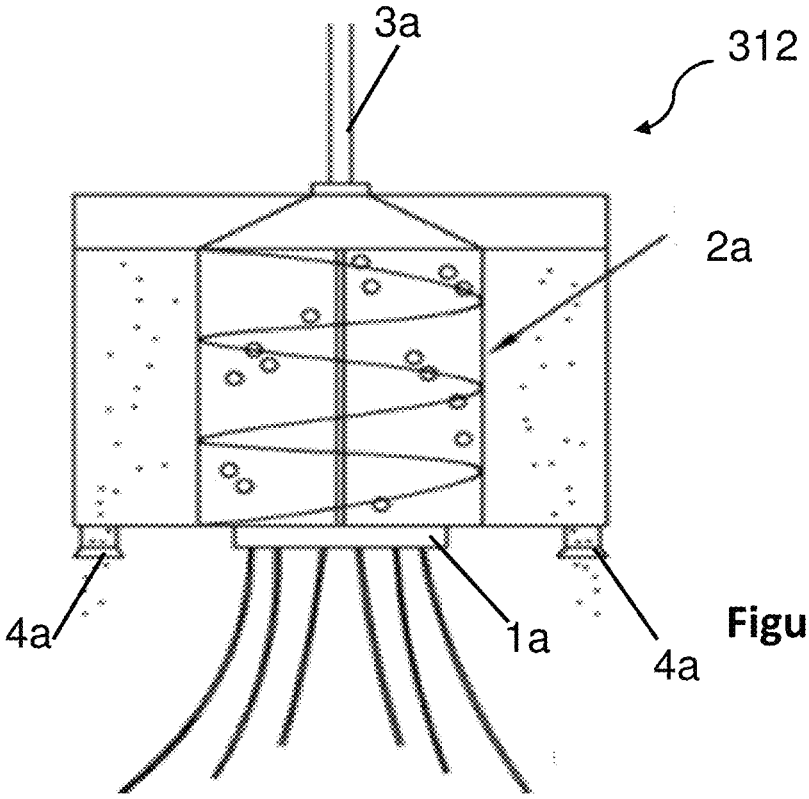
FIGS. 4A to 4C provide three different types of filtering modules which can be interchangeably used in the apparatus for collecting seabed resources.
Figure 4B:
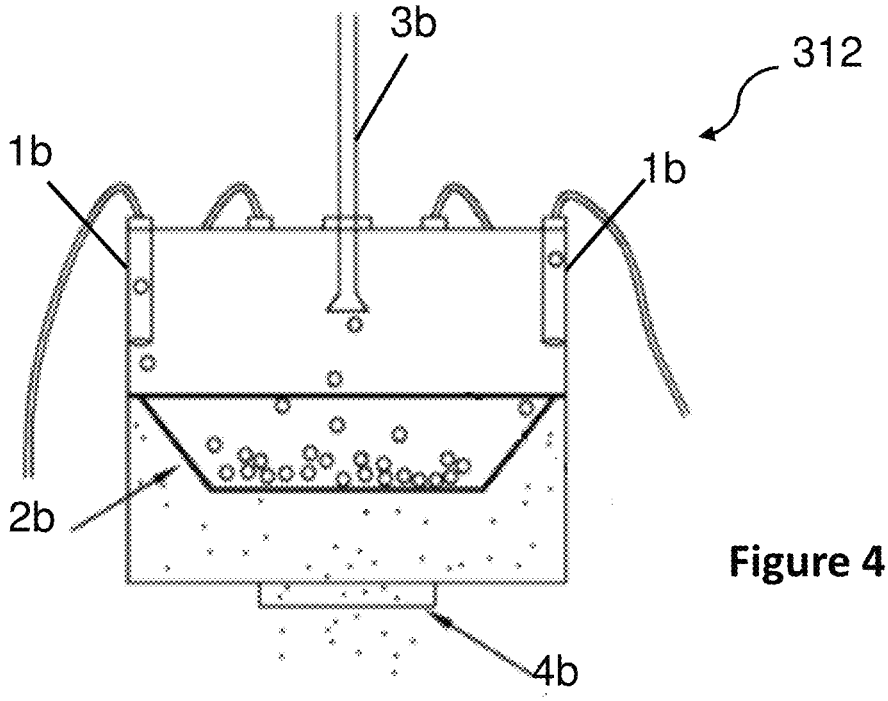
Figure 4C:
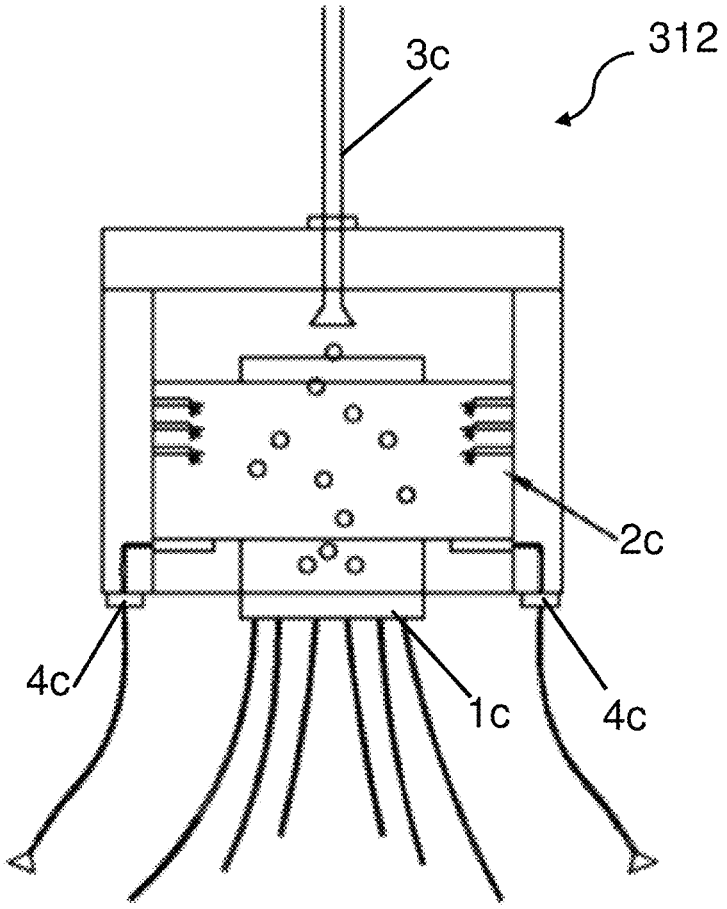

FIGS. 4A to 4C respectively provide three different types of filtering modules which can be used in the apparatus 300 either alone or in any combination thereof, i.e. each of the three filtering modules can work as a stand-alone or in conjunction with at least one of the other filtering modules, e.g. the three filtering module may work together in series i.e. one after another, in the apparatus 300. It should be noted that the three types of filtering modules can also be used individually or in any combination in the apparatus 100/200 in the first/second embodiments.

In the first type of filtering module 312 shown in FIG. 4A, the at least one input/feed channel includes an inlet 1*a* located at/near the bottom of the main module 310. The filter includes a centrifugal system 2*a* having a chamber defined by a wall with mesh filters. The centrifugal system 2*a* is arranged to drive sand particles and/or slurry out of the chamber through the mesh filters. The sand particles and/or slurry are to be discharged from the filtering module 312 through at least one waste discharge channel. In this example, the at least one waste discharge channel includes two outlets 4*a* located at bottom of the main module 310. The filtered seabed resources which remained in the chamber are to be transported out of the filtering module 312 through at least one output channel to the storage module 314. In this example, the at least one output/filtrate channel includes a connecting pipe 3*a* connecting the filtering module 312 to the storage module 314.

In the second type of filtering module 312 shown in FIG. 4B, the at least one input/feed channel includes a plurality of inlet tubes 1*b* located at/near the top of the main module 310. The filter includes a perforated structure 2*b* with a trapezoidal cross-section, e.g. bowl, arranged to separate the seabed resources from the sand particles and/or slurry. It is to be appreciated by a skilled person in the art that in other embodiments, the perforated structure 2*b* may have other shapes and structure, e.g. plate, as long as it can be used to receive the collected seabed resources and at least partially remove the sand particles and/or slurry from the seabed resources. The at least one output/filtrate channel includes a suction pipe 3*b* connecting the filtering module 312 to the storage module 314. The filtered seabed resources are transported to the storage module 314 by a hydraulic suction mechanism through the suction pipe 3*b*. The at least one waste discharge channel includes an outlet 4*b* located at/near bottom of the main module 310 and arranged to discharge the sand particles and/or slurry out of the main module 310 by a pump suction system.

In the third type of filtering module 312 shown in FIG. 4C, the at least one input/feed channel includes an inlet 1*c* located at/near the bottom of the main module 310. The filter includes a jet sprinkler system 2*c* arranged to direct one or more streams of water to wash the sand particles and/or slurry off the seabed resources and allow the sand particles/slurry fall into at least one waste discharge channel. The at least one output/filtrate channel includes a suction pipe 3*c* connecting the filtering module 312 to the storage module 314. The filtered seabed resources are transported to the storage module 314 by a hydraulic suction mechanism through the suction pipe 3*c*. The at least one waste discharge channel includes two discharging pipes 4*c* located at/near bottom of the main module 310 and connecting to the jet sprinkler system 2*c* to allow the sand particles and/or slurry to be discharged out of the main module 310.

Figure 8:
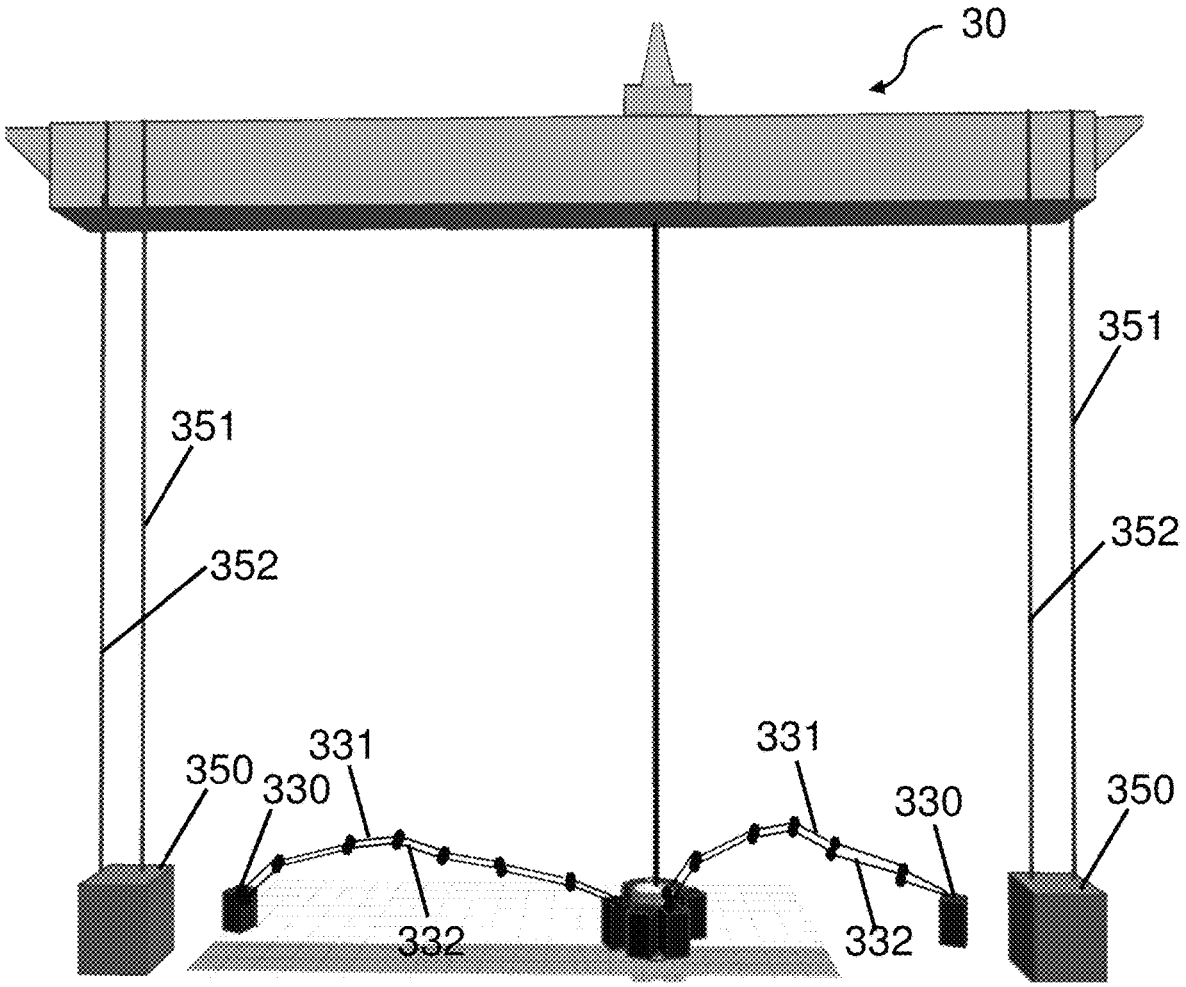
FIG. 8 shows two seabed sitting frames launched from the surface vessel and landed on the seabed according to the third embodiment of the invention.
Figure 9:
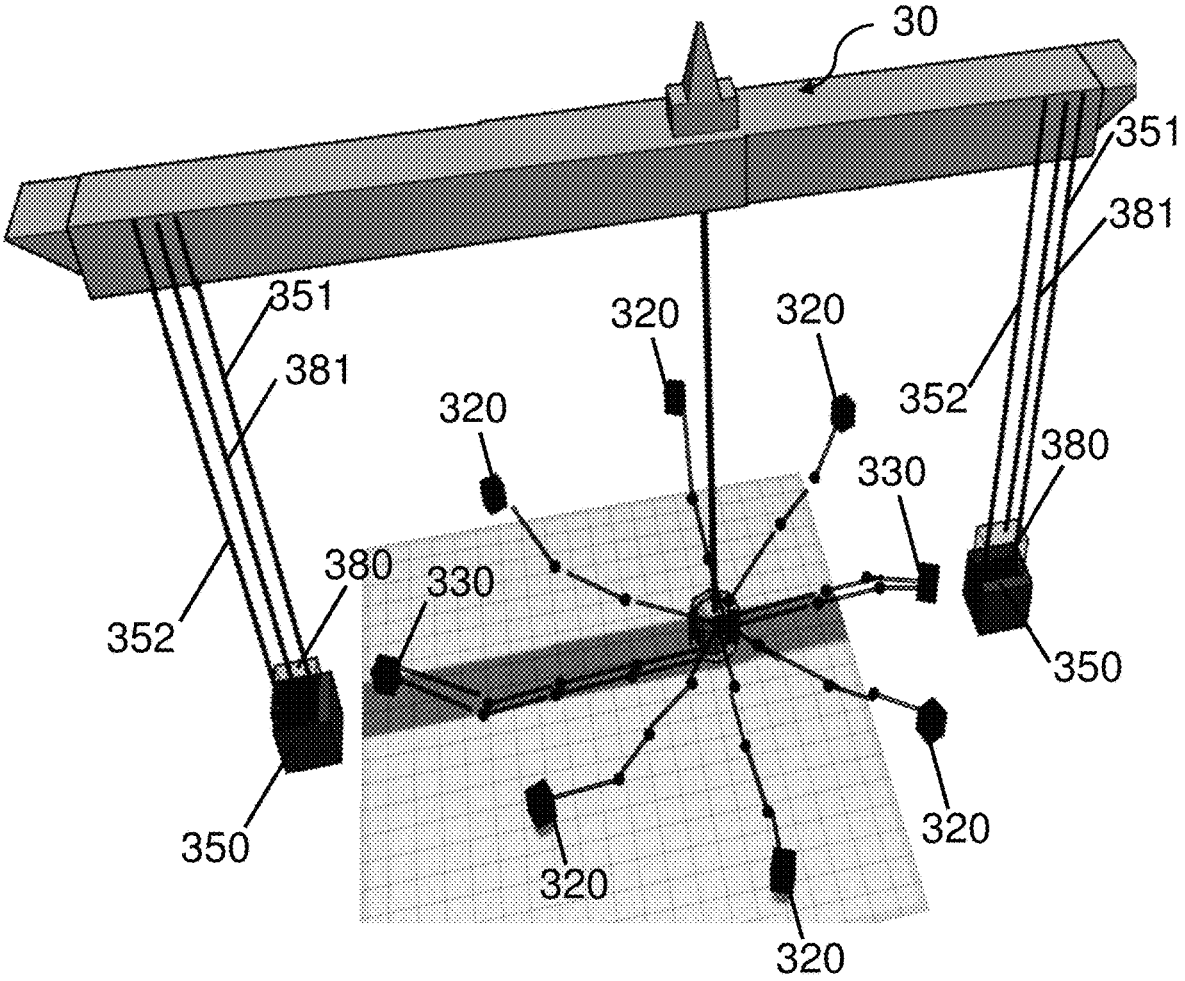
FIG. 9 shows two containers which are launched from a surface vessel and respectively positioned on/at different seabed sitting frames according to the third embodiment of the invention.
Figure 10:
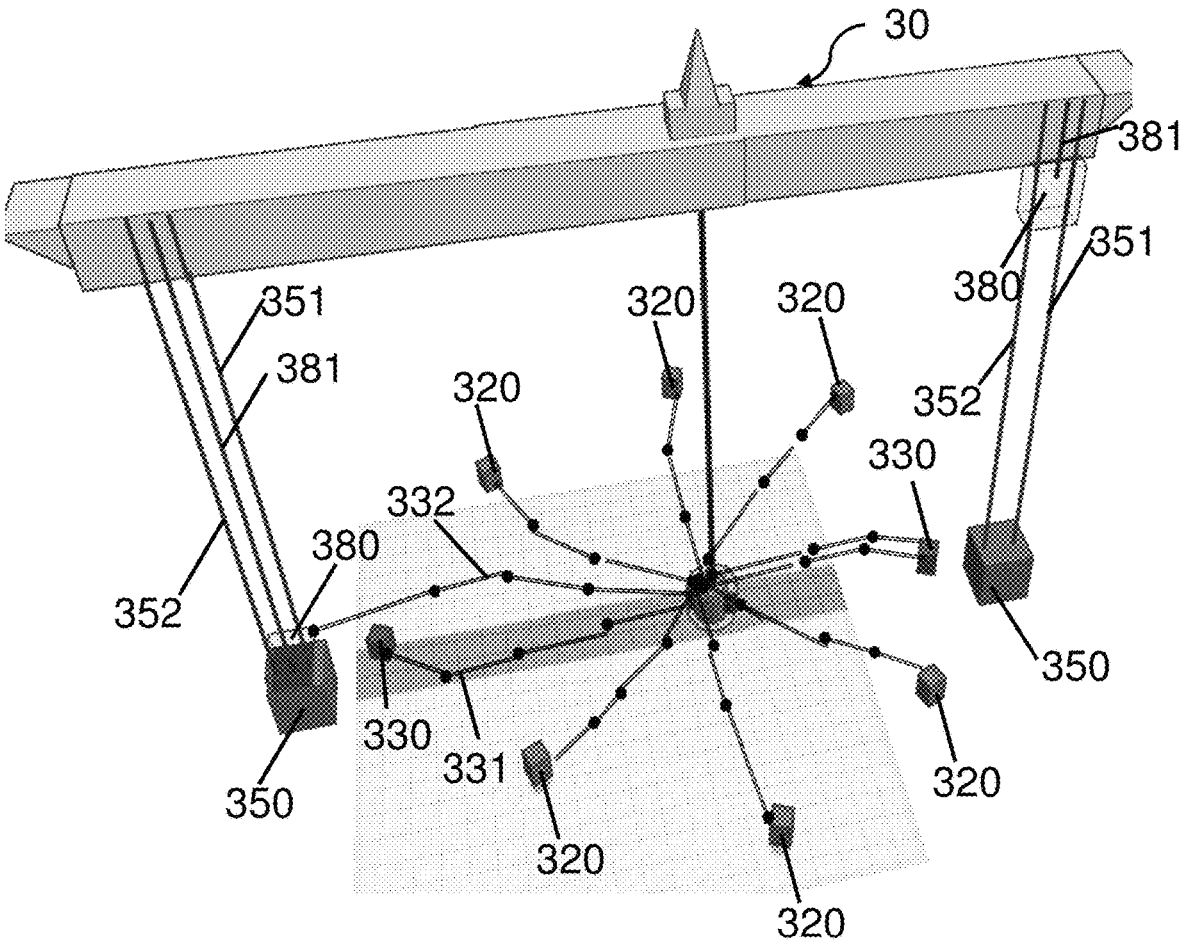
FIG. 10 shows one container which is connected to the main module through a connecting hose by the intervention ROV and another container being lowered towards the seabed according to the third embodiment of the invention.

To further improve efficiency of transferring seabed resources from the main module 310 to the surface vessel 30, in some embodiments of the invention, the apparatus 300 may be further provided with a conveying system including at least one pair of seabed sitting frame 350 and container 380 (indicated in FIG. 8 to FIG. 10).

The seabed sitting frame 350 is configured to be launched from the surface vessel 30 and landed on the seabed, e.g. by an A-shaped frame using launching ropes 351 and 352 and guide rails. The container 380 is configured to be launched/lowered from the surface vessel 30 along a guide system formed by the seabed sitting frame 350 and the launching ropes 351 and 352 and positioned on the seabed sitting frame 350. After the container 380 is positioned on the seabed sitting frame 350, the container 380 is fluidly connected to the main module 310 and configured to receive seabed resources transferred from the main module 310 and be lifted up to the surface vessel 30 by a winch.

To efficiently control the transfer of the seabed resources from the main module to the container, the conveying system may further include an intervention Remotely Operated Vehicle (ROV) 330. The intervention ROV 330 is configured to assist with launching and landing of the seabed sitting frame 350 onto the seabed, and control a connection between the container 380 and the main module 310.

To assist with launching and landing of the seabed sitting frame 350 onto the seabed, the intervention ROV 330 may be configured to determine if there are obstacles or undulations on the seabed based on information relating to the characteristics of the seabed collected by at least one scanning device, to ensure the seabed sitting frame 350 is landed/sitting on a flat seabed. In addition, the ROV 330 may be further configured to determine a distance between the seabed sitting frame 350 and the main module 310, and adjust the distance therebetween if the determined distance is smaller than a predetermined value.

To control the connection between the container 380 and the main module 310, the intervention ROV 330 may be configured to enable a connection between the container 380 and the main module 310 to allow seabed resources to be transferred from the main module 310 to the container 380, e.g. attach a connecting hose from the main module 310 to the container 380. The intervention ROV 330 may be further configured to disable the connection between the container 380 and the main module 310 when the container 380 is filled up with seabed resources, e.g. detach the connecting hose from the container 380. Optionally, the intervention ROV 330 may be configured to provide a signal to the main module 310 to trigger opening or closing of a valve at the connecting hose between the container 380 and the main module 310. Thus, the main module 310 can control the transfer of the seabed resources from the main module 310 to the container 380.

In some embodiments of the invention, the main module 310 may be further provided with a depth transducer which is configured to ensure that the main module 310 is to be launched on a flat seabed such that the main module 310 can be firmly secured to the seabed through activating some suction actuators. Specifically, the depth transducer may be configured to collect information with respect to the seabed bathymetry and determine if the seabed is sufficiently flat for landing of the main module 310.

In some embodiments of the invention, the main module 310 may be further provided with a latching system which is configured to control release of the collecting devices 320 from the main module 110 after the apparatus 300 is launched; and further configured to reattach the collecting devices 320 to the main module 310 before the apparatus 300 is returned to the surface vessel 30, i.e. after the process of seabed resources is completed and the apparatus 300 is to be returned back to the surface vessel 30. In some embodiments, the latching system may be remotely actuated to release or reattach the collecting devices 320 to the main module 310. In one example, the latching system may include a pneumatic or a hydraulic system. Specifically, the latching system may be configured to release the collecting devices 320 attached to the main module 310 such that the collecting device 320 can start to collect seabed resources, and reattach the collecting devices 320 to the main module 310 upon completion of the seabed resources collection.

Embodiments of the invention also provide a method for collecting seabed resources using the apparatus 300. The method at least includes the following steps: the apparatus 300 is launched from a surface vessel 30 towards a seabed and remotely controlled by the surface vessel 30; the main module 310 determines a mining path for each of the plurality of collecting devices 320 based on characteristics of the seabed; each of collecting devices 320 is released from the main module 310 and starts to collect seabed resources along the mining path determined by the main module 310; and the main module 310 controls the collecting devices 320 to collect seabed resources along the determined mining paths and control transfer of the seabed resources from the collecting device 310 to the surface vessel 30.

Figure 5:
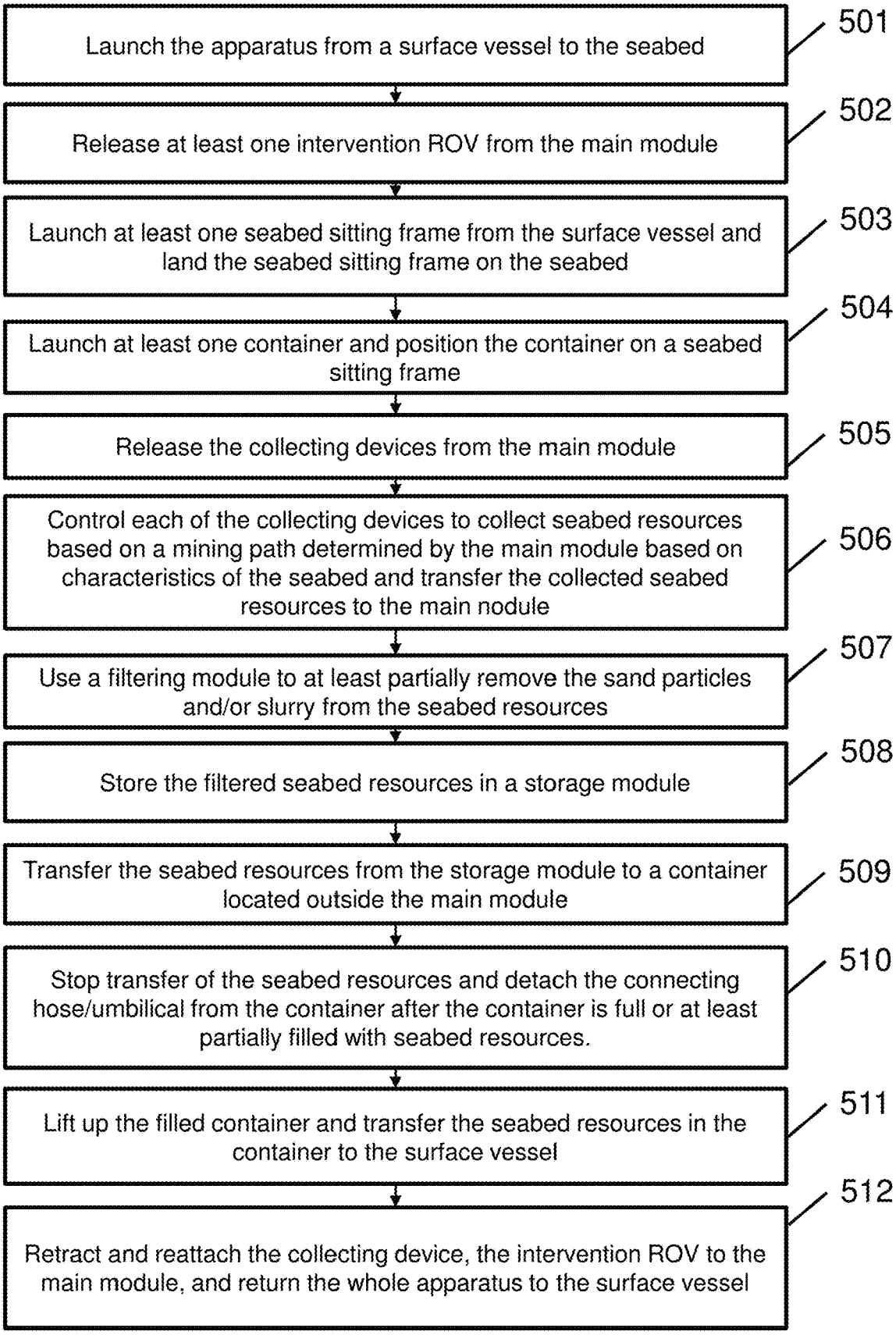
FIG. 5 is a flow chart illustrating a method for collecting seabed resources using the apparatus in FIGS. 3A to 3C according to the third embodiment of the invention.

FIG. 5 is a flowchart illustrating a method of collecting seabed resources according to the third embodiment of the invention.

In block 501, the apparatus 300 is launched, e.g. lowered, from a surface vessel 30 to the seabed.

Figure 6A:
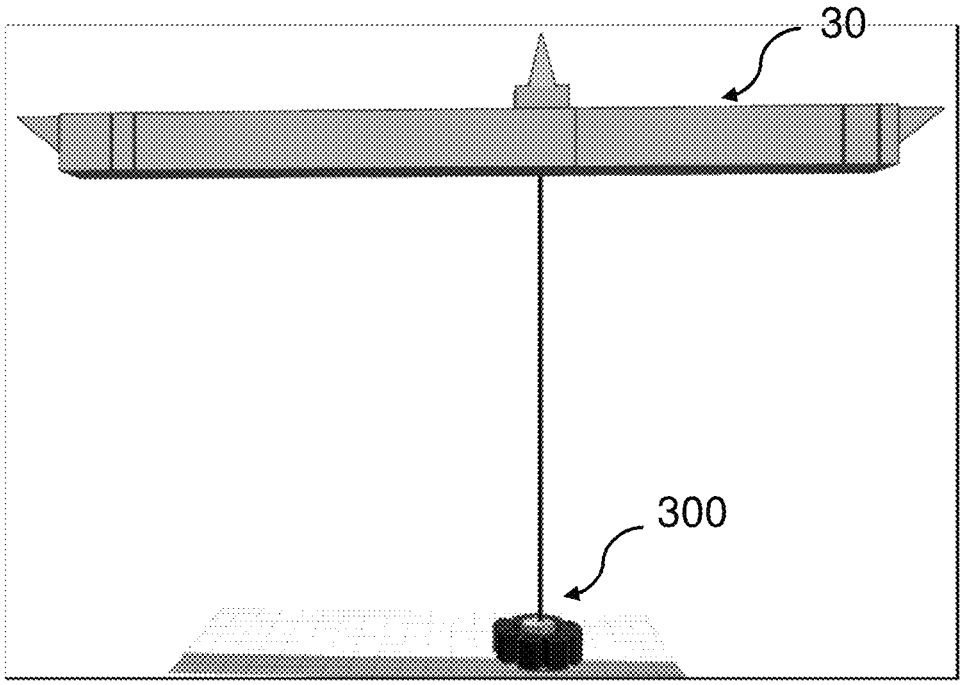
FIG. 6A shows a process of launching the apparatus from a surface vessel to the seabed according to the third embodiment of the invention.
Figure 6B:
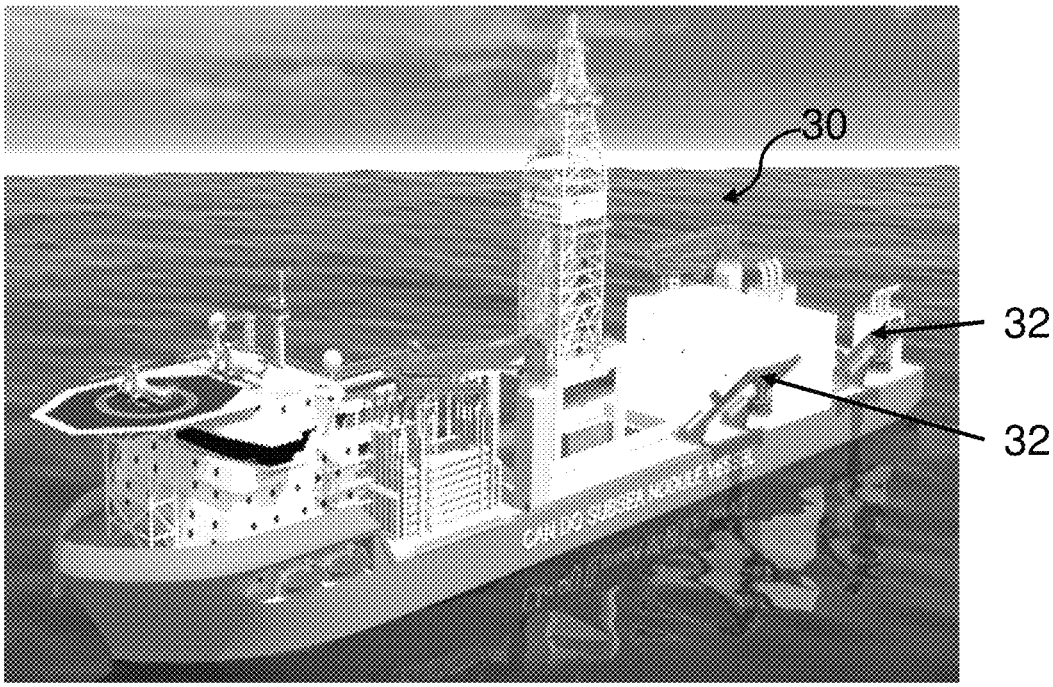
FIG. 6B shows a surface vessel having an A-shaped frame.

In this embodiment, the whole apparatus 300 is lowered and positioned on the seabed. FIG. 6A shows a process of launching the apparatus 300 from a surface vessel 30 to the seabed according to this embodiment of the invention. In one example, the apparatus 300 may be launched from a surface vessel 30 to the seabed by a launching rope using moonpool or sideway controlled launching method. In the moonpool controlled launching method, the apparatus 300 is lowered to the seabed through a moon pool provided on the surface vessel. In the sideway controlled launching method, the apparatus 300 is launched from the side of the surface vessel 30 using an A-shaped frame 32 as shown in FIG. 6B.

In some embodiments of the invention, after the apparatus 300 is lowered to the seabed, the main module 310 is secured to the seabed through activating one or more actuators provided at the bottom of the main module 310. To firmly secure the main module 310 to the seabed using the suction actuators, the main module 300 must be positioned on a relatively flat seabed, which may be realized by using a depth transducer provided on the main module 310.

In some embodiments, the launching rope is a strong fibre or steel rope with sockets for supporting umbilical and power cables. The umbilical and power cables provide power and communication transfer from the surface vessel 30 to the main module 310.

In block 502, after the apparatus 300 is secured or fixed on the seabed, at least one intervention Remotely Operated Vehicle (ROV) 330 is released from the main module 310 of the apparatus 300.

Each intervention ROV 330 is used to assist with launching and landing of a seabed sitting frame 350 which is provided for positioning a container 380.

Figure 7:
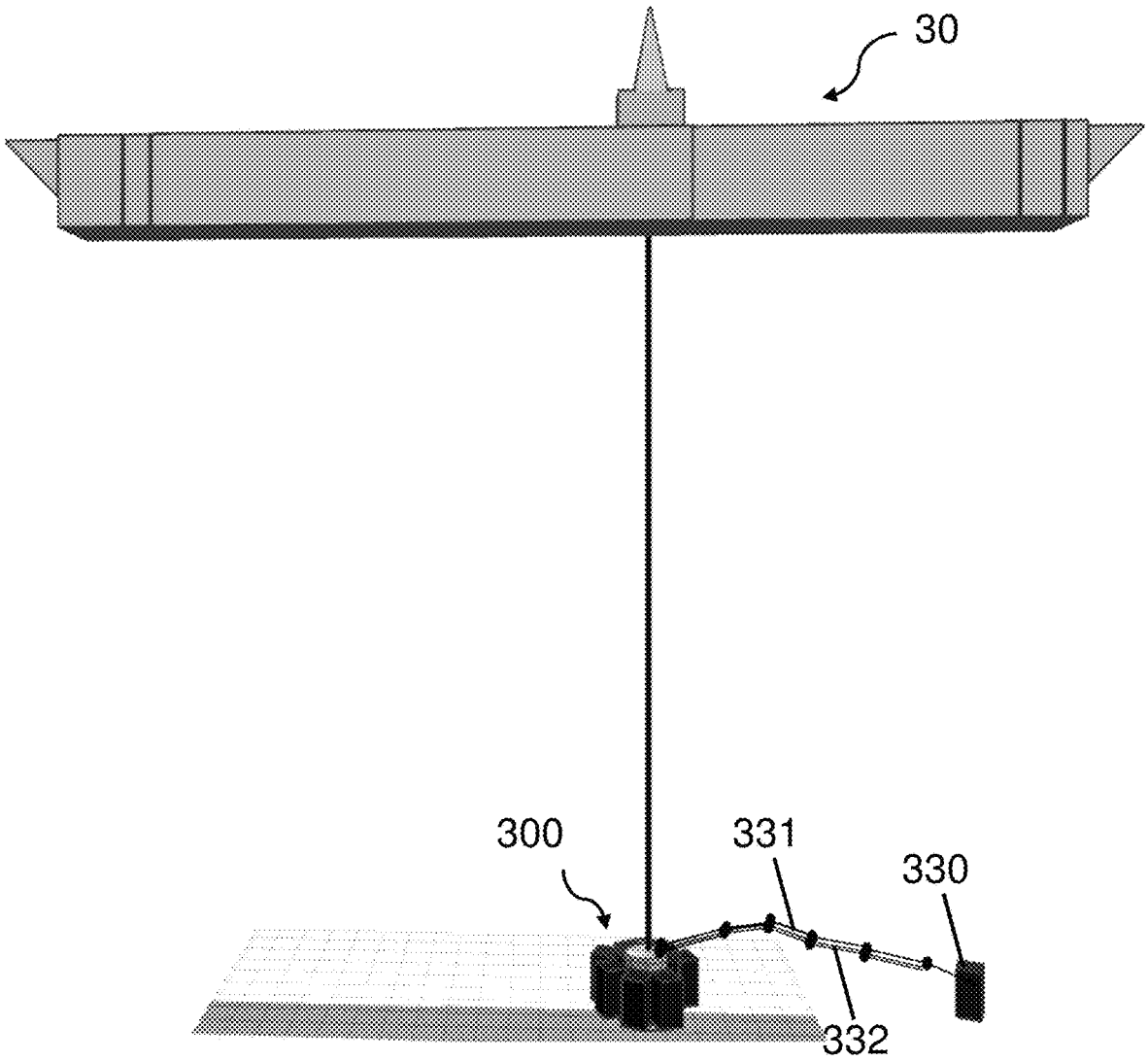
FIG. 7 shows a connection between an intervention ROV and a main module after the intervention ROV is launched from the main module.

FIG. 7 shows a connection between an intervention ROV 330 and the main module 310 after the intervention ROV 330 is launched from the main module 310. As shown in FIG. 7, in this example, the intervention ROV 330 is connected to the main module 310 by an umbilical 331. In addition, the intervention ROV 330 also carries a second connecting hose/umbilical 332 which is connected to the main module 310 and attaches the connecting hose 332 to the container 380 to allow seabed resources to be transferred from the main module 310 to the container 380 (as shown in FIG. 10).

In block 503, at least one seabed sitting frame 350 is launched from the surface vessel 30 and landed on the seabed.

FIG. 8 shows two seabed sitting frames 350 launched from the surface vessel 30 and landed on the seabed according to the third embodiment of the invention.

In some embodiments, a seabed sitting frame 350 may be launched from the surface vessel 30 by an A-shaped frame using launching ropes 351 and 352 and guide rails and the seabed sitting frame 350 may reach or land on the seabed due to its own weight.

Each seabed sitting frame 350 is provided for positioning a container 380 located outside the main module 310. The seabed sitting frame 350 together with the taut launching ropes 351 and 352 can provide a guide system between the surface vessel 30 to the seabed for controlled launching of a container 380.

Each intervention ROV 330 may be equipped with scanning devices/sensors, e.g. altimeter sensors, transponders, sonar sensors and cameras, which are used to collect information relating to characteristics of the seabed. The ROV 330 is used to determine if there are obstacles or undulations on the seabed based on the collected information to ensure the seabed sitting frame 350 is landed/sitting on a flat seabed. The scanning devices, e.g. sonar, transponders and cameras, may be also used to determine the distance between the main module 310 and the seabed sitting frame 350. In the event that the two bodies 310, 350 move too close to each other, the intervention ROV 330 is used to relocate, e.g. push/pull, the seabed sitting frame 350 to a desired location by using its manipulations and tools. Typically, the distance between the main module 310 and the seabed sitting frame 350 is 80 meters to 100 meters. Once the seabed sitting frame 350 sits on the seabed, the suction actuators are activated to firmly hold the seabed sitting frame 350 onto the seabed and at the same time, the launching ropes 351 and 352 are made taut and kept under constant tension, e.g. by using winches on the surface vessel 30.

It is to be appreciated by a skilled person in the art that more than one seabed sitting frame may be provided in some embodiments.

In block 504, at least one container 380 is launched from the surface vessel 30 and respectively positioned on a seabed sitting frame 350. Each intervention ROV 330 connects a container 380 to the main module 310 through a connecting hose/umbilical 332.

FIG. 9 shows two containers 380 which are launched and respectively positioned on/at two seabed sitting frames 350 according to the third embodiment of the invention. FIG. 10 shows one container 380 is connected to the main module 310 through a connecting hose 332 which is carried by the intervention ROV 330. As shown in FIG. 10, in this example, two seabed sitting frames 350 are provided to respectively position two separate containers 380. Accordingly, two intervention ROV 330 are provided to respectively assist with launching and landing of the two separate seabed sitting frames 350 and control connection between the main module 310 and the two separate containers 380.

Each container 380 has permanent ballast and thereby can reach the seabed using its own weight. As shown in FIG. 9, the launching control and recovery of the container 380 is performed by means of a launching rope 381. Each container 380 may use the taut launching ropes 351 and 352 of a seabed sitting frame 350 as a guide system to reach the seabed. With the guide system provided by the seabed sitting frame 350, the container 380 can reach on the seabed at a designated location. In absence of this guide system, drag forces due to the seawater current will cause drifting of the container 380 to a far location, and thereby impeding the mineral transfer operation.

Alternatively, in some embodiments of the invention, each seabed sitting frame 350 may be replaced with a self-propulsion system, e.g. water jet propulsion or thrusters or propellers, which is provided at the container 380 to resist the drag forces due to the seawater current.

In block 505, the collecting devices 320 are released from the main module 310 and respectively deployed spaced apart at various positions away from the main module 310.

As shown in FIG. 9, after the two containers 380 are respectively positioned on the seabed sitting frames 350, the collecting devices 320 are released from the main module 310 and respectively located at positions spaced apart away from the main module 310.

In block 506, each of the collecting devices 320 is controlled by the main module 310 to collect seabed resources along the mining path which has been determined by the main module 310 based on characteristics of the seabed. The collected resources are subsequently transferred to the main module 310.

In one example, the collection devices 320 may collect seabed resources by hydraulic suction which is provided by the pump assembly 315 provided in the main module 310. Also, using the pump assembly 315, the collected seabed resources are transferred to the main module 310.

In one example, the method may further include: each of the collecting device 320 collects information relating to characteristics of the seabed by using at least one scanning device, e.g. sensor, and sends the collected information to the main module 310; and the main module 310 determines a mining path for each collecting device 320 based on the received information.

In block 507, the main module 310 uses a filtering module 312 to at least partially remove the sand particles and/or slurry from the seabed resources.

In block 508, the filtered seabed resources are temporarily stored in the storage module 314 in the main module 310.

As mentioned above, the filtering module 312 may be any type of filtering module which can be used in the apparatus 300 to at least partially remove the sand particles and/or slurry from the seabed resources, for example, the filtering module 312 shown in any of FIGS. 4A to 4C.

In block 509, the seabed resources stored in the storage module 314 are transferred to a container 380 through a connecting hose/umbilical 332 which is connected from the storage module 314 to the container 380 by the intervention ROV 330.

In one example, the intervention ROV 330 sends a signal to the main module 310 to trigger opening of a valve of/at the connecting hose such that the seabed resources can be transferred to the container 380 from the main module 310.

The pump assembly 315 provided in the main module 310 may be used to transfer the seabed resources from the storage module 314 to the container 380.

In block 510, after the container 380 is full or at least partially filled with seabed resources, the transfer of seabed resources from the main module 310 to the container 380 is stopped and the connecting hose/umbilical 332 is detached from the container 380 by the intervention ROV 330.

In one example, when the container 380 is full or at least partially filled with seabed resources, the intervention ROV 330 sends a signal to the main module 310 to trigger closing of a valve at the connecting hose/umbilical between the container 380 and the main module 310.

In block 511, the filled container 380 is lifted up by winches onto the surface vessel 30 and the seabed resources in the container 380 are subsequently transferred to a storage unit on/at the surface vessel 30. In one example, the seabed resources in the container 380 may be sucked by a hose and dumped to a storage bay on the surface vessel 30.

If more than one container 380 are launched and positioned on the seabed, then the steps 509 to 511 will be repeated for the remaining containers 380.

In block 512, after the collection process (including transfer to container 380) completes, the collecting devices 320 and the intervention ROV 330 are retracted and reattached to the main module 310. The whole apparatus 300 in retracted position, including the seabed sitting frame 350, is then returned to the surface vessel 30 either sequentially or simultaneously.

It should be noted that the method described above is only for illustrative purpose, and not used to limit the scope of the invention. The sequence of the steps for launching the main module, the at least one intervention ROV, the at least one seabed sitting frame, the at least one container and the collecting devices may be modified in other embodiments of the invention. For example, the steps 504 and 505 may be carried out at the same time as long as when the collected seabed resources need to be transferred from the main module 310 to the container 380, the installation of the container 380 and connection between the container 380 and the main module 310 have been completed.

With the apparatuses and methods for collecting seabed resources disclosed above, a plurality of collecting devices can be controlled by a main module to collect seabed resources simultaneously along the mining paths determined by the main module. Moreover, as the main module is configured to control transfer of the seabed resources from the collecting devices to the main module and/or from the main module to the container, the efficiency of transfer of the seabed resources will be significantly improved. Further, at least one container located on the seabed may be used to temporarily store the collected seabed resources before transferring the seabed resources to the surface vessel to further increase the efficiency of transfer of the seabed resources.

It is to be understood that the embodiments and features described above should be considered exemplary and not restrictive. Many other embodiments will be apparent to those skilled in the art from consideration of the specification and practice of the invention. The scope of the invention should, therefore, be determined with reference to the appended claims, along with the full scope of equivalents to which such claims are entitled. Furthermore, certain terminology has been used for the purposes of descriptive clarity, and not to limit the disclosed embodiments of the invention.

The invention claimed is:

1. An apparatus for collecting seabed resources, the apparatus comprising:

a main module and a plurality of seabed resources collecting devices releasably attached to the main module by being configurable between a retracted position in which the collecting devices are latched to the main module and an extended position in which the collecting devices are unlatched and spread out from the main module, wherein each collecting device is provided with at least one sensor configured to collect information relating to characteristics of the seabed, wherein the main module and the plurality of collecting devices are configured to be launched in the retracted position from a surface vessel towards a seabed and released into the extended position after launch, wherein the main module includes a control module which is configured to determine a mining path for each of the collecting devices based on the collected information, determine whether there is overlap between the mining paths for the collecting devices based on the collected information and adjust the mining path for at least one of the collecting devices if there is overlap, control each of the collecting devices to collect seabed resources along the determined mining path and control transfer of the seabed resources collected by the collecting devices, wherein each collecting device is configured to collect the seabed resources along the mining path determined by the main module after being released into the extended position.

2. The apparatus according to claim 1, wherein the characteristics of the seabed are selected from the group consisting of: bathymetry, geographical features of the seabed, intensity distribution and volume of seabed resources on the seabed, and soil strength of the seabed.

3. The apparatus according to claim 1, wherein the main module further includes a filtering module which is configured to at least partially remove sand particles and/or slurry from the seabed resources collected by the collecting devices.

4. The apparatus according to claim 3, wherein the filtering module includes a centrifugal system and a chamber defined by a wall with mesh filters, wherein the centrifugal system is arranged to drive sand particles and/or slurry out of the chamber through the mesh filters; and/or a perforated structure arranged to separate the seabed resources from the sand particles and/or slurry; and/or a jet/water sprinkler system arranged to wash the sand particles and/or slurry off the seabed resources.

5. The apparatus according to claim 3, wherein the main module further includes a storage module which is configured to temporarily store the filtered seabed resources transferred from the filtering module.

6. The apparatus according to claim 1, wherein the main module further includes a latching system which is configured to control release of the collecting devices from the main module after the apparatus is launched; and to reattach the collecting devices to the main module before the apparatus is returned to the surface vessel.

7. The apparatus according to claim 6, wherein the latching system includes a pneumatic piston or hydraulic system.

8. The apparatus according to claim 1, further comprising a conveying system fluidly connected to the main module and configured to receive seabed resources from the main module and transfer the received seabed resources to the surface vessel; wherein the main module is further configured to control transfer of the seabed resources from the main module to the conveying system.

9. The apparatus according to claim 1, wherein the conveying system comprises a thruster assisted Vertical Transport System (VTS) which is connected to the surface vessel by an umbilical for power transfer and communication therebetween and configured to be launched from the surface vessel, receive seabed resources from the main module after being fluidly connected to the main module and be lifted up to the surface vessel after being at least partially filled with seabed resources;

wherein the main module is further configured to control transfer of seabed resources from the main module to the VTS.

10. The apparatus according to claim 9, wherein the VTS includes a vectored thruster configured to counteract drag forces from seabed current and move the VTS along a substantially vertical path;

a container configured to store seabed resources which is to be transferred to the surface vessel; and a connecting means configured to fluidly connect the VTS to the main module and enable transfer of seabed resources from the main module to the VTS.

11. The apparatus according to claim 1, wherein the main module and the plurality of collecting devices are configured to be positioned at a predetermined height above the seabed after being launched from the surface vessel.

12. The apparatus according to claim 11, further comprising a buoyancy module and frame and at least one vector thruster which are configured to counteract drag forces from seabed current and maintain the main module and the plurality of collecting devices at the predetermined height above the seabed.

13. The apparatus according to claim 1, wherein each collecting device is movably and communicably connected to the main module by a hybrid flow hose for power, resource and information/data transfer therebetween after being released from the main module.

14. The apparatus according to claim 1, wherein each collecting device is configured to communicate with the main module in a wireless manner after being released from the main module and return to the main module after being at least partially filled with seabed resources;

wherein the main module is further configured to control transfer of the seabed resources from the collecting device to the main module after the at least partially filled collecting device is reattached to the main module.

15. The apparatus according to claim 8, wherein the main module and the plurality of collecting devices are configured to be positioned on the seabed after being launched from the surface vessel, wherein the conveying system comprises a seabed sitting frame and a container, wherein the seabed sitting frame is configured to be launched from the surface vessel and landed on the seabed, wherein the container is configured to be launched from the surface vessel and positioned on the seabed sitting frame where the container is fluidly connected to the main module to receive seabed resources transferred from the main module; and configured to be lifted up to the surface vessel by winches to transfer the received seabed resources to the surface vessel.

16. The apparatus according to claim 15, wherein the seabed sitting frame is arranged to be launched from the surface vessel by an A-shaped frame using launching ropes and guide rails, and lowered to the seabed due to its own weight; and wherein the container is arranged to be launched from the surface vessel along a guide system formed by the seabed sitting frame and the launching ropes.

17. The apparatus according to claim 14, further comprising an intervention Remotely Operated Vehicle (ROV) which is configured to assist with launching and landing of the seabed sitting frame on the seabed, and control the connection between the container and the main module.

18. A method for collecting seabed resources, comprising:

launching an apparatus for collecting seabed resources from a surface vessel towards a seabed, wherein the apparatus includes a main module and a plurality of collecting devices releasably attached to the main module, wherein the apparatus is launched in a retracted position in which the collecting devices are latched to the main module;

releasing the collecting devices from the main module by arranging the apparatus in an extended position in which the collecting devices are unlatched and spread out from the main module;

collecting, by each of the collecting devices, information relating to characteristics of the seabed and sending the collected information to the main module;

determining, by the main module, a mining path for each of the plurality of collecting devices based on the collected information;

determining, by the main module, whether there is overlap between the mining paths for the collecting devices based on the collected information, and adjusting, by the main module, the mining path for at least one of the collecting devices if there is overlap;

controlling, by the main module, each of the collecting devices to collect seabed resources along the mining path determined by the main module; and controlling, by the main module, transfer of the seabed resources collected by the collecting devices.

19. The method according to claim 18, wherein the characteristics of the seabed are selected from the group consisting of bathymetry, geographical features of the seabed, intensity distribution and volume of seabed resources on the seabed, and soil strength of the seabed.

20. The method according to claim 18, further comprising:

filtering, by a filtering module provided in the main module, the seabed resources collected by the collecting devices to at least partially remove the sand particles and/or slurry from the seabed resources.

21. The method according to claim 20, wherein the filtering module includes a centrifugal system and a chamber defined by a wall with mesh filters and/or a perforated structure and/or a jet/water sprinkler system, wherein the step of filtering the seabed resources comprises:

driving the sand particles and/or slurry out of the chamber through the mesh filters; and/or separating, by the perforated structure, the seabed resources from the sand particles and/or slurry; and/or washing by the jet/water sprinkler system, the sand particles and/or slurry off the seabed resources.

22. The method according to claim 20, further comprising:

temporarily storing the filtered seabed resources in a storage module provided in the main module.

23. The method according to claim 18, wherein the step of releasing the collecting devices from the main module by arranging the apparatus in an extended position in which the collecting devices are unlatched and spread out from the main module comprises:

controlling a latching system to release the collecting devices from the main module after launching the apparatus;

and the method further comprising:

controlling the latching system to reattach the collecting devices to the main module before the apparatus is returned back to the surface vessel.

24. The method according to claim 23, wherein the latching system includes a pneumatic piston or hydraulic system.

25. The method according to claim 18, further comprising:

transferring, by a conveying system, the seabed resources from the main module to the surface vessel.

26. The method according to claim 25, wherein the conveying system includes a thruster assisted Vertical Transport System (VTS), and the method further comprises:

launching the thruster assisted Vertical Transport System (VTS) from the surface vessel to a predetermined location above the seabed;

connecting the VTS to the main module to enable transfer of the seabed resources from the main module to the VTS;

transferring the seabed resources from the main module to the VTS;

disconnecting the VTS from the main module after the VTS is at least partially filled with seabed resources; and lifting up the at least partially filled VTS to the surface vessel.

27. The method according to claim 18, wherein the step of launching the apparatus from the surface vessel towards the seabed comprises:

lowering the main module and the plurality of collecting devices from the surface vessel and positioning the main module and the plurality of collecting devices at a predetermined height above the seabed.

28. The method according to claim 27, further comprising:

providing at least one vector thruster connected to the main module; and using the at least vector thruster to counteract drag forces from seabed current to ensure the apparatus moves along a substantially vertical path and maintain the apparatus at the predetermined height above the seabed.

29. The method according to claim 18, wherein each collecting device is movably and communicably connected to the main module by a hybrid flow hose for power, resource and information/data transfer therebetween.

30. The method according to claim 18, wherein after releasing the collecting devices from the main module, the method further comprises:

transferring information/data between the main module and each of the collecting devices in a wireless manner;

reattaching, a collecting device, to the main module after the collecting device is at least partially filled with seabed resources and returns to the main module; and transferring the collected seabed resources from a collecting device to the main module after the collecting device is reattached to the main module.

31. The method according to claim 25, wherein the conveying system includes a seabed sitting frame and a container, the method further comprising:

launching the seabed sitting frame from the surface vessel and landing the seabed sitting frame on the seabed;

launching the container from the surface vessel and positioning the container on the seabed sitting frame;

fluidly connecting the main module to the container to enable transfer of seabed resources from the main module to the container;

disconnecting the connection between the main module and the container after the container is at least partially filled with seabed resources; and lifting up the at least partially filled container to the surface vessel by winches.

32. The method according to claim 31, wherein the step of launching the seabed sitting frame comprises: launching the seabed sitting frame from the surface vessel by an A-shaped frame using launching ropes and guide rails and lowering the seabed sitting frame due to its own weight;

wherein the step of launching the container comprises: launching the container from the surface vessel along a guide system formed by the seabed sitting frame and the launching ropes.

33. The method according to claim 31, wherein the conveying system further comprises an intervention ROV, wherein the method further comprises:

using the intervention ROV to assist with launching and landing of the seabed sitting frame on the seabed; and using the intervention ROV to control the connection between the main module and the container.

34. The method according to claim 33, wherein the step of using the intervention ROV to control the connection between the main module and the container comprises:

enabling, by the ROV, the connection between the container and the main module before transferring seabed resources from the main module to the container; and disabling, by the ROV, the connection between the container and the main module after the container is at least partially filled with the seabed resources.

* * * * *